United States Patent [19]

Barker

[11] Patent Number: 4,961,880

[45] Date of Patent: Oct. 9, 1990

[54] ELECTROSTATIC VOLTAGE EXCITATION PROCESS AND APPARATUS

[75] Inventor: William A. Barker, Los Altos, Calif.

[73] Assignee: Altran Corporation, Sunnyvale, Calif.

[21] Appl. No.: 239,146

[22] Filed: Aug. 31, 1988

[51] Int. Cl.[5] ..... G21F 9/00; G21G 1/00; G21G 1/121; G21G 1/10

[52] U.S. Cl. ..... 252/626; 252/627; 376/146; 376/156; 376/157; 376/190; 376/276

[58] Field of Search ..... 376/156, 157, 158, 170, 376/171, 172, 180, 181, 182, 190, 191, 194, 196, 197, 146–148, 275, 276; 252/625, 626, 627

[56] References Cited

U.S. PATENT DOCUMENTS

| | | | |
|---|---|---|---|
| 2,500,223 | 3/1950 | Wells et al. | 376/156 |
| 3,518,432 | 6/1970 | Uleski | 376/156 |
| 3,974,390 | 8/1976 | Morita et al. | 250/306 |
| 4,364,898 | 12/1982 | Meyer et al. | 376/190 |

FOREIGN PATENT DOCUMENTS

| | | | |
|---|---|---|---|
| 7171987 | 7/1987 | Australia . | |
| 0012640 | 6/1969 | Japan | 376/158 |
| 0063588 | 5/1977 | Japan | 376/158 |
| 1034539 | 6/1966 | United Kingdom | 376/158 |

OTHER PUBLICATIONS

McGervey, 1971 *Introduction to Modern Physics* Academic Press, N.Y. "Nuclear Transformation" pp. 508–514.

Raumfhhrtforschung (5/71) pp. 208–209, Winterberg, "Rocket Propulsion by Thermonuclear Microbombs Ignited With . . . ".

Physical Review (1/49), vol. 75, No. 1., Segré et al., "Experiments on the Effect of Atomic Electrons on the Decay Constant. . . ".

*Primary Examiner*—Howard J. Locker

*Attorney, Agent, or Firm*—Skjerven, Morrill, MacPherson, Franklin & Friel

[57] ABSTRACT

Accelerated decay of radioactive materials is used for power production. In the method of this invention an alpha-emitting radioactive material is placed in a region. The region is selected so that when a negative potential is applied to the region, enhanced alpha decay of the radioactive material results. The energy of the alpha decay particles is captured and converted to thermal energy.

10 Claims, 7 Drawing Sheets

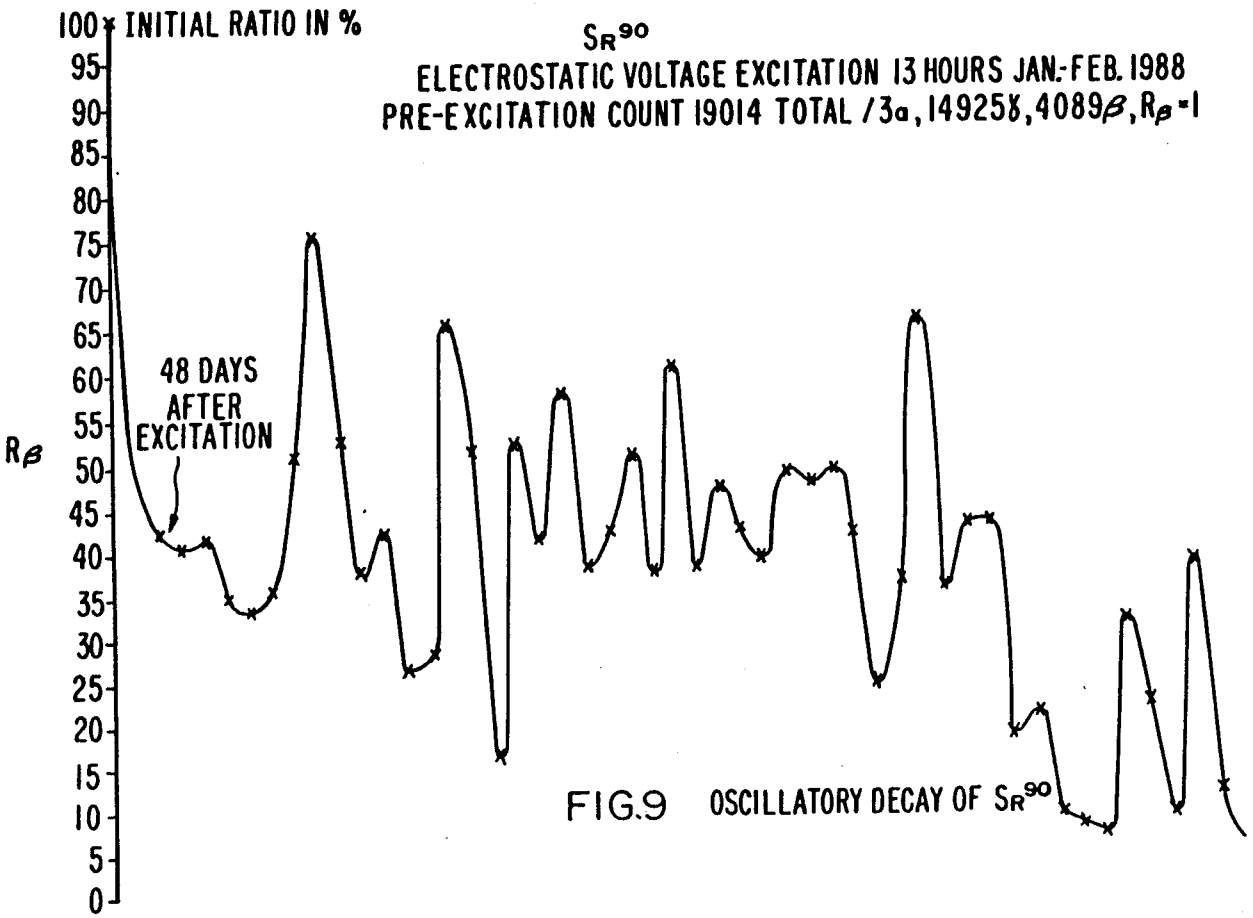
FIG.9 OSCILLATORY DECAY OF $Sr^{90}$

ELECTROSTATIC VOLTAGE EXCITATION PROCESS AND APPARATUS

This application is a continuation-in-part of U.S. application Ser. No. 112,854 filed Oct. 23, 1987 and entitled "COLLECTIVE VIBRATIONS IN THE ELECTRONICS SYSTEM OF RADIACTIVE WASTES", now abandoned.

I. INTRODUCTION AND BASIC THEORY

This patent disclosure describes applications of the electrostatic voltage excitation process for: (1) Decontamination of radioactive waste at nuclear power sites and elsewhere; (2) The generation of nuclear power using alpha, beta and gamma emitting materials as fuel; (3) The generation of fusion power by the use of the deuterium in water as fuel; and (4) The production of precious metals like rhodium and platinum by accelerated alpha decay.

These advances in the field of nuclear chemistry became possible by the discovery that the rates of decay of alpha, beta and gamma emitters change dramatically when they are energized with a high electrostatic voltage. An electrostatic generator such as a Van de Graaff generator, is suitable for carrying out this process. Its spherical or cylindrical terminal receives a charge from a moving, insulated belt or chain. The electrostatic field inside the cavity is zero by Gauss' theorum, while beyond the terminal surface a field exists. For a sphere the field is: $\vec{E}=Q/(4\pi\epsilon 0r^2)\uparrow$ where "Q" is the surface charge on the sphere. The electrostatic potential is constant inside the sphere and on its surface, which is a key point. For a sphere the potential is: $\phi=Q/(4\pi\epsilon 0a)$ with "a" the sphere radius. Outside the sphere, the potential is $\phi=Q/(4\pi\epsilon 0r)$, which goes to zero for large distances "r" from the sphere's center.

If the charge on the terminal is negative, the corresponding voltage $\phi$ inside the cavity and on its surface is negative. The second terminal on the generator is usually grounded, in which case the potential difference between the terminals is: $\Delta\phi=-|Q|/(4\pi\epsilon 0a)$. The potential energy of a charge q inside the cavity is $q\phi$. An alpha particle of charge 2e has a potential energy of $-2|e\phi|$. Only outside the cavity will the alpha particle be accelerated towards the negatively charged surface.

Consider a radioactive alpha source located in an energized cavity or hollow body of a Van de Graaff generator. The electrostatic voltage is constant throughout the cavity and the source material in the cavity. The potential energy of the Coulomb barrier, resisting particle escape, is lowered by $2|e\phi|$ from $2Ze^2/r$. The decay rate of the radioactive source material increases exponentially with the negative voltage. Electrostatic voltage excitation, therefore, modifies the Coulomb barrier of the material. The electrons in the atoms and the protons in the daughter nuclei of the source material are also excited but they produce a lesser effect.

Experimental documentation for this disclosure is provided by:

(a) A scientific summary of radioactive decay, nuclear stability, the energetics of decay processes, and fission. This material, presented in Appendix A, is well known in the scientific community and it provides a background for the current application.

(b) U.S. patent application, Ser. No. 112,854, filed Oct. 23, 1987, (now abandoned) incorprated herein by reference, describes how electrostatic voltage excitation can serve to decontaminate radioactive sources.

(c) A scientific manuscript entitled, Thorium 230 Decay by Coulomb Barrier Modification, Appendix B.

(d) A scientific manuscript entitled, The Theory of the Rapid Depletion of Alpha Decay by Electrostatic Voltage Excitation. Experimental verification for Thorium 230 and Polonium 210, Appendix C.

(e) A scientific manuscript entitled, The Theory of Accelerated Beta Decay by Electrostatic Voltage Excitation. Experimental verification for Thallium 204 and Lead 210 in Appendix D herein.

(f) A scientific manuscript entitled, The Fusion of Deuterons in Water by Electrostatic Voltage Excitation, Appendix E.

The primary object of the present invention is to provide apparatus and a method for using electrostatic voltage excitation to modify the Coulomb barrier of material, such as radioactive materials or water, to enhance alpha, beta and gamma decay from the materials or to provide for low voltage deuteron-deuteron fusion, whereby said materials can be decontaminated or be used for generating power as well as for the transmutation of one metal of low value into another metal of high value.

Other objects of this invention will become apparent as the following specification progresses, reference being made to the accompanying drawings for an illustration of several embodiments of the apparatus of the invention.

IN THE DRAWINGS

FIG. 9 is a plot of oscillatory delay of strontium 90; and

II. Decontamination

Figure 1:
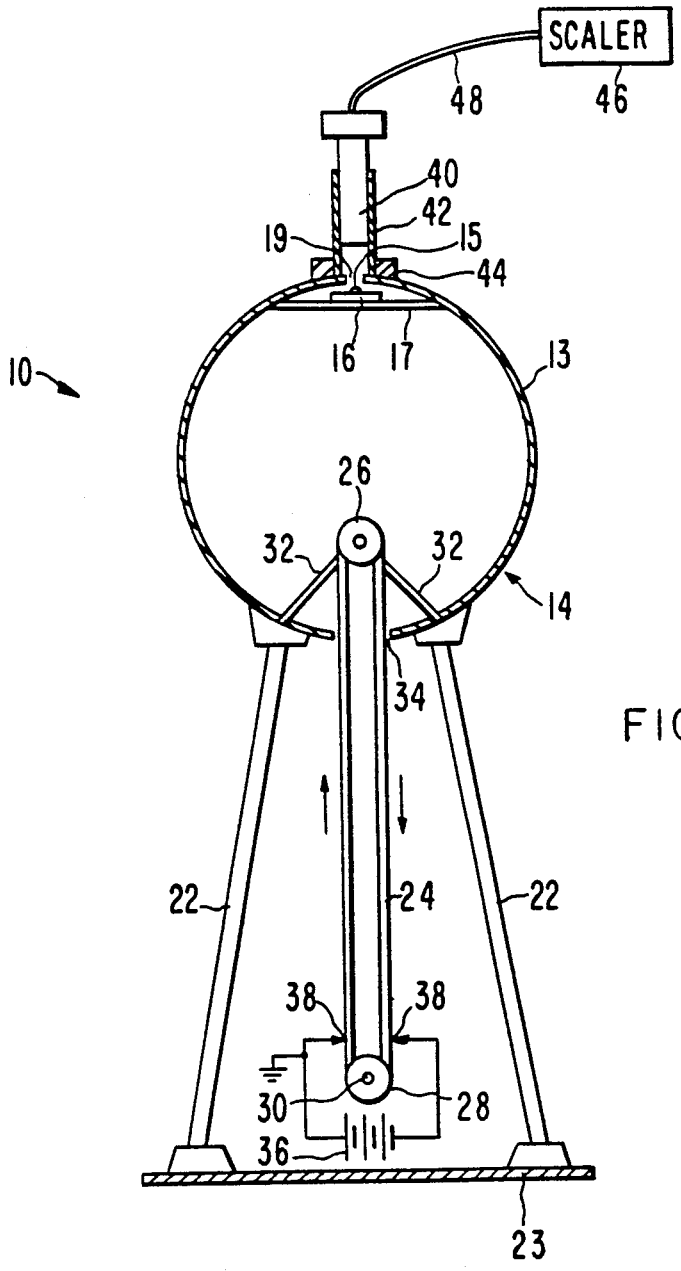
FIG. 1 is a schematic view of an electrostatic generator of the present invention used to enhance alpha, beta, and gamma decay of radioactive materials with the counter sensor for detecting the particle decay being external to the hollow body of the generator.

The principal source of radioactive waste is at nuclear power plants, where the spent fuel rods are stored underwater. There are about 400 nuclear power plants in the world, of which 106 are located in the United States. There are definite plans for the construction of 225 more plants worldwide. The spent fuel rods, and other radioactive waste produced by this nation's operating fission burner reactors has been accumulating since 1945. The level of radioactive waste in the United States is now estimated to be anywhere from 9,000 to 40,000 metric tons. The worldwide radioactive waste from fission power plants may well be in excess of 100,000 metric tons.

There is widespread radioactive contamination in other locations.

(1) Mill tailings: Long lived uranium and thorium debris left at the mill after the uranium has been exhausted from the parent rock.

(2) Transuranic waste (atomic number greater than 92, like plutonium) produced in the nuclear weapons program.

(3) Spent $U^{235}$ rods used in U.S. submarines and other naval vessels, and spent fuel rods from the ships of the USSR and other nations.

(4) Radioactive waste stored in saltmines and other geologic sites.

(5) Extensive surface contamination of islands in the Pacific, used as testing grounds for the hydrogen bomb by the United States and France.

(6) Underground contamination at H bomb test sites in Nevada and in the USSR.

(7) Contaminated areas produced by accidents at nuclear power plants like Chernobyl.

(8) Accidental spillage or loss of radioactive material in transit, at manufacturing sites, or in hospitals (as in Brazil).

In U.S. patent application Ser. No. 112,854 filed Oct. 23, 1987 (abandoned), several techniques for radioactive decontamination are described. The most effective method is by electrostatic voltage excitation where the contaminated material is placed inside an electrostatic generator (Van de Graaff), operating at voltages, ~250 kV to 850 kV. The voltage on the surface of the generator terminal is constant throughout the terminal cavity, including all the atoms in the contaminated source. The electrostatic field inside the cavity is zero, which means that charged particles of the contaminated source are not accelerated until after they exit the cavity of the high voltage terminal.

Inside the cavity, the potential energy of each particle of charge q is increased by an amount $q\phi$, where $\phi$ is the terminal voltage. If $\phi$ is negative, the potential energy of alpha particles is decreased by $2|e\phi|$, whereas the potential energy of electrons is increased by $|e\phi|$. The Coulomb barrier of the alpha particle is lowered to $2Ze^2/r-2|e\phi|$, resulting in accelerated decay. Many of the atomic electrons are ionized. This change in electron charge distribution increases beta decay.

There are other decontamination methods discussed in the above patent application. Prominent among these methods is laser excitation. Experiments show that electrostatic voltage excitation is more effective than laser excitation. This is especially the case when the contamination samples are large in comparison with spot size. Electrostatic voltage excitation should be used when there are large volumes of radioactive waste awaiting decontamination, as at nuclear power plants.

It should be emphasized that extensive evidence has been obtained to demonstrate decontamination by electrostatic voltage excitation. Laser excitation of radioactive sources does generate vibrations in the rate of counting of alpha particles, but it is not known whether or not accelerated decay takes place. Accelerated decay has been observed for all radioactive sources subjected to electrostatic voltage excitation in a Van de Graaff generator, (see FIG. 1 of U.S. patent application Ser. No. 112,854) (abandoned), for a period of six hours or more. We define this as activity which is substantially different from the initial unexcited activity.

We have observed that two alpha sources and two beta sources decay to background in a time relatively short compared with their lifetimes. Typically, such a change is observed in the counting rate anywhere from six days to six weeks after excitation. The post-excitation reaction mode is a transient, with a relaxation time of the order of six weeks or more. The activity in counts per second undergoes oscillatory decay.

We have observed two alpha sources and one gamma source in the process of accelerated decay. Evidently, the voltages were not high enough to lead to total decay in several weeks. In the test apparatus used, the Van de Graaff voltage is limited by the relative humidity. If the relative humidity is 50% or higher, we cannot get sustained voltages above 200 keV. This results in accelerated decay and partial decontamination. We have experimental evidence that alpha, beta and gamma decay are all accelerated by electrostatic voltage excitation. Technical details for the decontamination of alpha and beta emitters are given in Appendices B, C, and D.

Accelerated decay in the gamma decay of $Am^{241}$ has been observed. The source we used was a closed 54.2 micro-curie alpha emitter. This source was embedded in a plastic cylinder six mm thick so that no alphas were detectable. The radiation which penetrates the cylinder is a discrete gamma spectrum consisting of nine gamma lines in the range from 11.871 to 59.5364 keV. Seven of these lines are associated with the excited states of neptunium, the alpha daughter of americium. The other two gammas are electric dipole transitions. The initial pre-excitation $Am^{241}$ count on our Geiger counter was 595 cps. Four weeks after excitation, the count had risen to 734 cps, and then it rose rather quickly to 1490 cps and 2508 cps, 4.2 times the initial value. It later dropped to about 1576 cps, a reasonably steady value. This is a clear evidence of accelerated gamma decay.

The $Am^{241}$ source was analyzed with an x-ray spectrometer at San Jose State University by Dr. Peter Englert, a radiation chemist. The numerical printout for the excited source was compared with an unexcited source.

Figure 10:
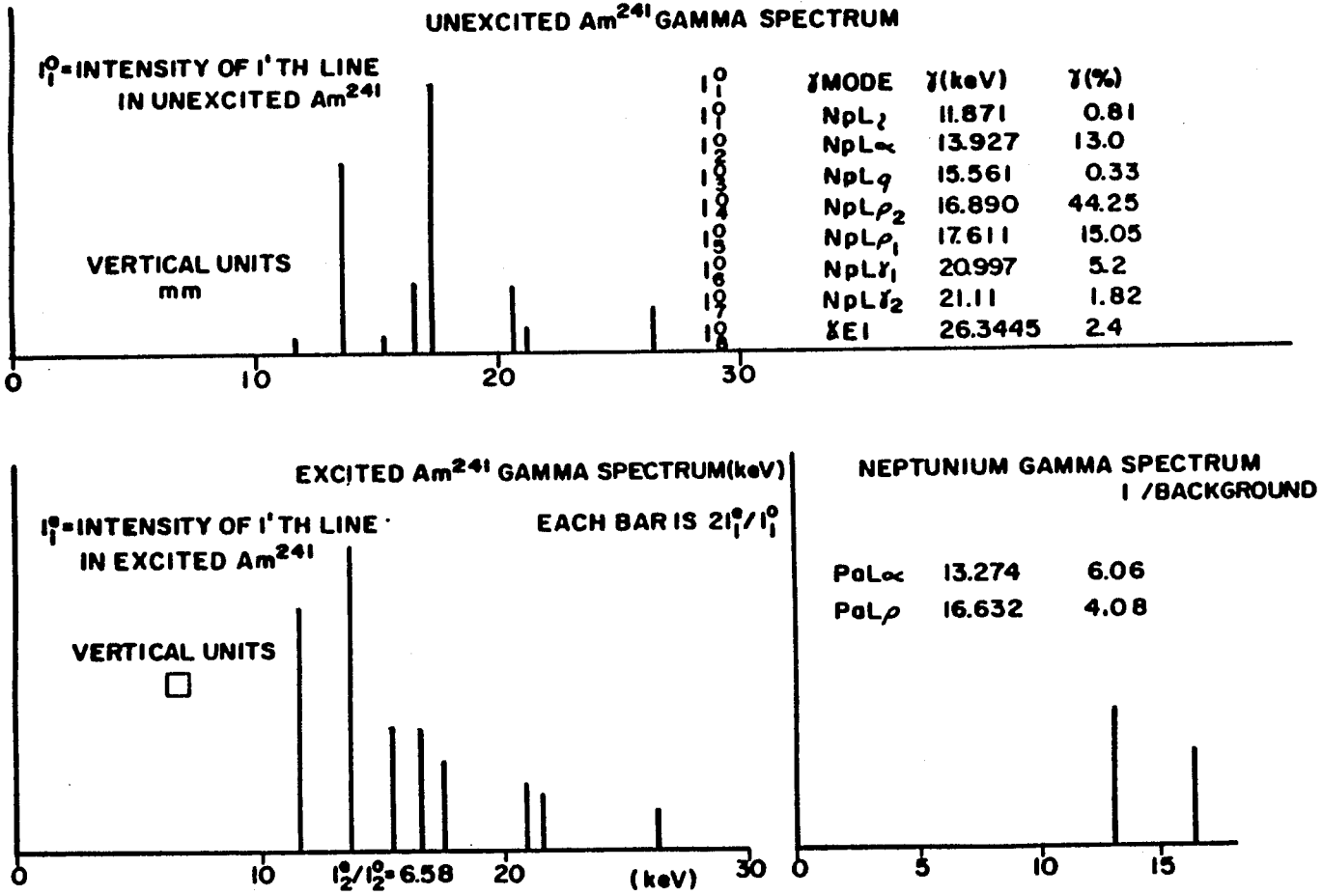
FIG. 10 is a plot of the unexcited and excited gamma decay spectrum of $Am^{241}$.

The spectra differ as shown in Table A-2*a* as follows: (1) All of the NpL lines in the excited source are more intense than in the unexcited source, but the $\gamma$El line is less intense. (2) The total count for the excited source exceeded that of the unexcited source by a factor of 2.15— a value which is about the same as the GM ratio. (3) There is evidence of PaL$\alpha$ and PaL$\beta$ in the excited spectrum. These are photons from Neptunium, the first alpha daughter of Americium (see FIG. 10).

Details are given in Table A-2*a*. These measurements and analysis suggest that $Am^{241}$ is undergoing accelerated alpha decay as reflected in the more intense NpL lines, the presence of the PaL lines, and in the higher overall gamma rate.

An electrostatic generator which illustrates decontamination in FIG. 1. The purpose of the generator is to excite the electrons, protons, and alpha particles inside the atoms in radioactive materials, thereby increasing the counting rate or rate of decay of alpha, beta and gamma particles from the materials and thereby decontaminating the materials.

The decontamination is accomplished in the generator of FIG. 1 by the application of a stimulus in the form of a negative electrical potential on the surface and inside the generator including all the atoms in the radiactive material. As the negative electrostatic potential excites the charged particles inside the atoms, the counting rate or rate of emission of alpha, beta and gamma particles is increased to thereby accelerate particle decay and thereby the decontamination of the radioactive materials.

Generator 10 includes hollow body or sphere 13 forming part of a generator mechanism 14. A radioactive sample 15 to be enhanced or decontaminated is placed on a platform 16 supported by a bracket 17 on the interior of sphere 13 near the upper end thereof adjacent to hole 19 in the sphere. Thus, the radioactive sample is within the sphere and will be subjected to the electrostatic potential generated in the sphere as hereinafter described.

The sphere 13 is supported on legs 22 on a base 23 which is grounded. Thus the sphere 13 must be maintained in spatial and electrical isolation from all other elements including the base plate 23. To this end, legs 22 must be electrical insulators.

Sphere 13 receives electrical charges by way of an insulated moving belt 24 which extends between an interior pulley 26 within sphere 13 and an exterior pulley 28 carried in some suitable manner and on base 23. Drive mechanism 30 is a motor providing rotation of motion of exterior pulley 128.

A voltage generator is located near pulley 28 near the base plate 23. Generator 36 delivers charges to belt 24 by way of a pair of electrically conducting needles 38 which contact belt 24 on either side of pulley 28. Generator 26 is typically capable of delivering voltages in the range of 50,000 to 500,000 volts.

The purpose of generator 10 is to provide a large negative electrostatic potential with no field at the site of the sample 15. This can be accomplished by placing the sample 15 anywhere within or on the sphere 13.

The radioactive sample 15 can comprise an alpha, beta or gamma emitter. An alpha emitter defining the sample 15 can be, for instance, thorium 230, uranium 235 or plutonium 239. These three sources have half lives of $8\times10^4$ years, $7.1\times10^8$ years and 24,360 years, respectively. There are a few hundred alpha emitters with half lives ranging from less than a millisecond ($Fr^{215}$) to billions of years (Uranium 238).

Tests were conducted with generator 10 with sample 15 located as shown in FIG. 1. These tests were conducted with the use of a Geiger-Mueller tube 40 adjustably carried by a tube 42 secured by an annular ring 44 to the outer surfaces sphere 13. Tube 42 surrounds hole 19 so that alpha, beta or gamma particles emitted from sample 15 will be directed to tube 40 and sensed thereby. A scaler 46 is coupled by a cable 48 to the Geiger-Mueller tube 40.

In the experimental work, the principal radioactive source was thorium 230 with an activity of 0.1 $\mu$Ci. This was sample 15. As thorium oxide, the sample was electrodeposited and diffusion bonded on platform 17 which, for purposes of illustration, was a 0.001 inch platinum plate in a metal cylinder with a diameter of 24 millimeters and a thickness of three millimeters. This source was made to specification by the Isotope Products Laboratories of Burbank, Calif.

The Geiger-Mueller tube 40 and scaler 46 were obtained from the Nucleus, Inc. of Oak Ridge, Tenn. The Geiger-Mueller tube (model PK2) detects alpha, beta and gamma particles. The scaler 46 (model 500) was coupled by cable 48 to the Geiger-Mueller tube, the cable being an eight foot coaxial MHP cable to shield the same against the effects of the high voltage generator 10.

Generator 10 was a 450,000 volt generator of negative polarity. It was obtained from the Wabash Instrument Company (model N 100-V) of Wabash, Ind. The diameter of sphere 13 of the generator was approximately 25 centimeters.

The sample 15 was housed in a metal clamp inside the sphere 13. This clamp was annular base 44 which can be wood or plastic on the outside of sphere 13. The sensor tube 40 was inserted to various depths into a 3.5 centimeter diameter hole in base 44. The size of hole 19 was 15 millimeters at the top of sphere 13.

The voltage achieved with the particular Van de Graaff generator was approximately 50,000 volts. Measurements of the voltage were made from spark lengths by estimating 30,000 volts per inch. A better measure is provided by the source-to-sensor distance. This gives reasonable voltage values if the speed of belt 24 is increased slowly to the point where there is an electron discharge and the scaler goes off scale.

The present invention postulates that an external, electrostatic potential penetrates to the center of each nucleus of each material. Rapid penetration of the potential is assured if the material is an electrical conductor and is housed in a metallic environment. The generator 10 is a simple and convenient high voltage source which acts to excite charged particles. On the spherical surface of radius a, the voltage is equal to $Q/4\pi\epsilon 0a$, where Q is the charge, negative or positive, delivered by the belt. This potential is constant inside the sphere 13 where the electrical field is zero at all locations within the sphere.

A series of experiments were carried out with thorium 230, and the experiments proved to be successful in that a substantial change in activity occurred when the generator 10 was switched from an off condition to an on condition. Over 1,000 experimental readings were taken which exhibit positive or negative enhancement. Qualitatively, the measurements always agreed with the theory. Table B-1 (Appendix B) shows, for thorium 230, theoretical and measured values of enhancement versus the potential of the generator 10.

The enhancement values have a standard deviation of about five percent. The voltage readings are accurate to 1.8 kv. The principal experimental difficulty was in measuring the voltage of the generator.

Figure 2:
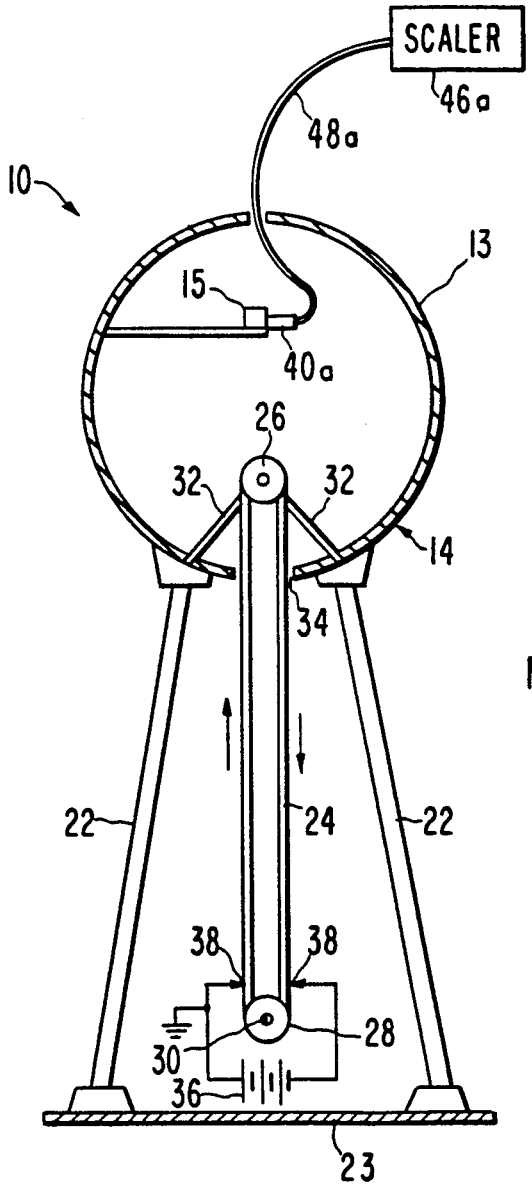
FIG. 2 is a view similar to FIG. 1 but showing the particle counter sensor within the hollow body of the generator to permit high voltage operation of the generator.

The generator 10 of FIG. 1 has limitations as to the voltage which it can generate due to the way in which the voltage is measured, i.e., by the height of the Geiger-Mueller tube 40 in tube 42. Thus, generator 10 is limited to relatively low voltages. To increase the voltage capability of the generator, a Geiger-Mueller sensor **40*a* is placed in sphere 13 adjacent to the sample 15 to be enhanced or decontaminated as shown in FIG. 2, and a relatively long, insulated lead 48*a* is coupled to the sensor and passes through opening 19 of sphere 13. The outer end of lead 48*a* is coupled to a scaler 46*a*. In this way, relatively high voltages can be achieved with a generator because of the elimination of the Geiger-Mueller sensor 40 as shown in FIG. 1**.

The Decontamination Tables describe the history of four sources. It is significant that independent calibrations were made before and after high voltage excitation.

Decontamination Table
Summary of Radiation Free Isotopes as of July 1988

| | Polonium 210 | Thorium 230* |
|---|---|---|
| 1. Radioactive source description | Alpha emitter<br>Decays to lead 206 in 1 step<br>Half life 138 days<br>Identification #200-88 | Alpha emitter<br>Decays to lead 206 thru several daughters<br>Half life $7.5 \times 10^4$ years<br>Sn 172-24-1 |
| 2. Independent calibration by | Isotope Products Labs.<br>10/1/87 Activity 0.1 microcurie<br>$\pm$ 15% Mass = $2.2 \times 10^{-5}$ $\mu$g | Isotope Products Labs<br>6/1/86 0.1 microcurie<br>$\pm$ 15% Mass = 4.8 $\mu$g |
| 3. Pre-excitation measurement by | W. Barker and W. Fiedler<br>Geiger Muller counter & scaler<br>9/15/87 356.53 alpha cps | W. Barker and W. Fiedler<br>GM counter system<br>9/15/87 94.39 alpha cps |
| 4. Excitation in Van de Graaf generator | Barker and Fiedler<br>9/17/87 14 hrs ~ 450 kV | Barker and Fiedler<br>9/17/87 14 hrs ~ 450 kV |
| 5. Post-excitation measurement by | Barker and Fiedler<br>GM count<br>(1) 9/20/87 364 cps $R_\alpha = 1.022$<br>(2) 9/23/87 159 cps $R_\alpha = 0.45$<br>(3) 9/26/87 110 cps $R_\alpha = 0.31$<br>(4) 11/15/87 Background $R_\alpha = 0$ | Barker and Fiedler<br>GM count<br>(1) 9/20/87 123 cps $R_\alpha = 1.3$<br>(2) 9/23/87 16.9 cps $R_\alpha = 0.2$<br>(3) 9/26/87 18.7 cps $R_\alpha = 0.2$<br>(4) 11/15/87 Background $R_\alpha = 0$ |
| 6. Independent Calibration by | A. Dr. Peter Englert, radiation chemist, San Jose State Un.<br>GM counter 2/23/88<br>(1) No measurable alpha count<br>(2) 1.25 cps total count<br>(Natural decay count after 291 days 94.0 cps) | A. Dr. Peter Englert<br>GM counter 2/23/88<br>(1) No alpha count<br>(2) 0.57 total cps<br>B. Bogert, Kevex Corp.<br>Foster City x-ray flourescence 7/88<br>(Natural decay count after 291 days 94.98 cps) |
| | **Thallium 204** | **Strontium 90** |
| 1. Radioactive source description | Beta emitter<br>Decays to lead 204 in 1 step<br>Half life 3.78 years | Betan and gamma emitter<br>Decays in two steps to zirconium 90<br>Half life 29 years |
| 2. Independent calibration by | The Nucleus, Inc., Oak Ridge<br>Activity 1 microcurie<br>Mass = $2.15 \times 10^{-3}$ microgram | The Nucleus, Inc.<br>Activity .01 microcurie (beta)<br>Mass = $7.3 \times 10^{-4}$ $\mu$g |
| 3. Pre-excitation measurement by | Barker and Fiedler<br>GM counter<br>9/15/87 1004 beta cps and gamma | Barker and Fiedler<br>GM counter<br>1/26/88 140 beta cps, 558 gamms cps |
| 4. Excitation in Van de Graaf generator | Barker and Fiedler<br>9/17/87 14 hours $\leqq$ 450 kV | Barker and Fiedler<br>1/26/88 13.5 hrs $\leqq$ 400 kV |
| 5. Post-excitation measurement by | Barker and Fiedler<br>GM counter<br>(1) 9/20/87 345 cps $R_\beta = .34$ ?<br>(2) 9/23/87 1072 cps $R_\beta = 1.07$<br>(3) 9/26/87 1037 cps $R_\beta = 1.04$<br>(4) 11/15/87 Background $R_\beta = 0$ | Barker and Fiedler<br>GM counter<br>(1) 3/23/88 53 $R_\beta = .38$<br>2078 gamma cps $R_\gamma = 3.73$<br>(2) 3/26/88 101 $R_\beta = .72$<br>2576 gamma cps $R_\gamma = 4.62$<br>(3) 3/29/88 19.4 $R_\beta = .14$<br>3139 gamma cps $R_\gamma = 5.63$<br>(4) 5/2/88 zero beta<br>2805 gamma $R_\gamma = 5.03$ |
| 6. Independent Calibration by | A. Dr. Peter Englert, Radiation chemist, San Jose State Un.<br>(1) GM count 4.93 cps<br>(2) Proportional counter<br>B. Bogert, Devex Corp., x-ray flourescence 7/88<br>No detectable radiation<br>Natural decay count after 291 days 867.6 cps | A. Bogert, Kevex Corp<br>x-ray flourescence<br>No detectable radiation<br>Natural decay count after 162 days 139 cps |

*The integrity of this source may have been compromised during the post-excitation period.

III. Nuclear Power by Alpha Decay

The generation of electrical energy and the decontamination of nuclear waste are of great social and economic significance. The electrostatic voltage excitation process is capable of accomplishing these two objectives at the same time.

III-A. Alpha Energy Compared to Fission Energy

Two fuel sources of interest in the development of alpha, beta and gamma power are Uranium 238 and Thorium 232. Their decay chains are detailed in Tables 1 and 2. The decay of one metric ton of $U^{238}$ to $Pb^{206}$ is the energy equivalent of about 3,500,000 barrels of oil.

Similarly the decay of one metric ton of $Th^{232}$ to $Pb^{208}$ is equivalent in energy to about 2,900,000 barrels of oil.

TABLE 1

| Conversion | Decay Chain for $U^{238}$ Half-life | Energy | Decay Mode |
|---|---|---|---|
| $_{92}U^{238}$ to $_{90}Th^{234}$ | $4.47 \times 10^9$ y | 4.268 MeV | $\alpha$ |
| $_{91}Pa^{234}$ to $_{92}U^{234}$ | 24.10 d | 0.270 | $\beta-$ |
| $_{92}U^{238}$ to $_{90}Th^{236}$ | $4.47 \times 10^9$ y | 4.268 | $\alpha$ |
| $_{90}Th^{234}$ to $_{91}Pa^{234}$ | 24.10 d | 0.270 | $\beta-$ |
| $_{91}Pa^{234}$ to $_{92}U^{234}$ | 6 h | 2.195 | $\beta-$ |
| $_{88}Ra^{226}$ to $_{86}Rn^{222}$ | 1600 y | 4.870 | $\alpha$ |
| $_{86}Rn^{222}$ to $_{84}Po^{218}$ | 3.82 d | 5.590 | $\alpha$ |
| $_{84}Po^{218}$ to $_{82}Pb^{214}$ | 3.11 m | 6.114 | $\alpha$ |
| $_{82}Pb^{214}$ to $_{83}Bi^{214}$ | 26.8 m | 1.032 | $\beta-$ |
| $_{83}Bi^{214}$ to $_{84}Po^{214}$ | 19.9 m | 3.27 | $\beta-$ |
| $_{84}Po^{214}$ to $_{82}Pb^{210}$ | $1.63 \times 10^{-4}$ s | 7.833 | $\alpha$ |
| $_{82}Pb^{210}$ to $_{83}Bi^{210}$ | 22.3 y | 0.063 | $\beta-$ |
| $_{83}Bi^{210}$ to $_{84}Po^{210}$ | 5.01 d | 1.16 | $\beta-$ |
| $_{84}Po^{210}$ to $_{82}Pb^{206}$ | 138.4 d | 5.407 | $\alpha$ |
| Total | $2.245 \times 10^{10}$ | | |

As one gram of $U^{238}$ decays to $Pb^{206}$, there is an energy release of $2.245 \times 10^{10}$ joules. This is equivalent in energy to about 3.67 barrels of oil; the decay energy of one metric ton of $U^{238}$ corresponds to the energy content of about 3,670,000 barrels of oil.

TABLE 1A

| Conversion | Decay Chain for $U^{235}$ Half-life | Energy (MeV) | Decay Mode |
|---|---|---|---|
| $_{92}U^{235}$ to $_{90}Th^{23}$ | $7.04 \times 10^8$ y | 4.68 | $\alpha$ |
| $_{90}Th^{231}$ to $_{91}Pa^{231}$ | 25.2 h | 0.389 | $\beta-$ |
| $_{91}Pa^{231}$ to $_{89}Ac^{227}$ | $3.27 \times 10^4$ y | 5.148 | $\alpha$ |
| $_{89}Ac^{227}$ to $_{90}Th^{227}$ | 21.77 y | 0.041 | $\beta-$ |
| $_{90}Th^{227}$ to $_{88}Ra^{223}$ | 18.72 d | 6.146 | $\alpha$ |
| $_{88}Ra^{223}$ to $_{86}Rn^{219}$ | 11.43 d | 5.979 | $\alpha$ |
| $_{86}Rn^{219}$ to $_{84}Po^{215}$ | 3.96 s | 6.946 | $\alpha$ |
| $_{84}Po^{215}$ to $_{82}Pb^{211}$ | 1.78 ms | 7.526 | $\alpha$ |
| $_{82}Pb^{211}$ to $_{83}Bi^{211}$ | 36.1 m | 1.374 | $\beta-$ |
| $_{83}Bi^{211}$ to $_{81}Tl^{207}$ | 2.14 m | 6.279 | $\alpha$ |
| $_{81}Tl^{207}$ to $_{82}Pb^{207}$ | 4.77 m | 1.427 | $\beta-$ |
| Total | | 45.940 MeV | |

The energy released as one gram of $U^{235}$ decays to $Pb^{207}$ is $1.88 \times 10^{10}$ joules/gram.

TABLE 2

| Conversion | Decay Chain for $Th^{232}$ Half-life | Energy | Decay Mode |
|---|---|---|---|
| $_{90}Th^{232}$ to $_{88}Ra^{228}$ | $1.40 \times 10^{10}$ y | 4.081 MeV | $\alpha$ |
| $_{88}Ra^{228}$ to $_{89}Ac^{228}$ | 5.75 y | 0.045 | $\beta-$ |
| $_{89}Ac^{228}$ to $_{90}Th^{228}$ | 6.13 h | 2.142 | $\beta-$ |
| $_{90}Th^{228}$ to $_{88}Ra^{224}$ | 1.913 y | 5.520 | $\alpha$ |
| $_{88}Ra^{224}$ to $_{86}Rn^{220}$ | 3.66 d | 5.789 | $\alpha$ |
| $_{86}Rn^{220}$ to $_{84}Po^{216}$ | 55.6 s | 6.404 | $\alpha$ |
| $_{84}Po^{216}$ to $_{82}Pb^{212}$ | 0.15 s | 6.906 | $\alpha$ |
| $_{82}Pb^{212}$ to $_{83}Bi^{212}$ | 10.64 h | 0.574 | $\beta-$ |
| $_{83}Bi^{212}$ to $_{84}Po^{212}$ | 1.009 h 64% | 2.248 | $\beta-$ |
| $_{84}Po^{212}$ to $_{82}Pb^{208}$ | $3 \times 10^{-7}$ s | 8.953 | $\alpha$ |
| Total | $1.867 \times 10^{10}$ joules/gram | | |
| $_{83}Bi^{212}$ to $_{81}Tl^{208}$ | 1.009 h 36% | 6.206 | $\alpha$ |
| $_{81}Tl^{208}$ to $_{82}Pb^{208}$ | 3.05 m | 4.994 | $\beta-$ |
| Total | $1.871 \times 10^{10}$ joules/gram | | |

The energy release by one gram of $Th^{232}$ as it decays to $Pb^{208}$ averages $1.876 \times 10^{10}$ joules. This is equivalent in energy to about 3.05 barrels of oil. The decay energy in one metric ton of $Th^{232}$ corresponds to the energy content of 3,050,000 barrels of oil.

There are large mineral deposits of $U^{238}$ in the United States, Canada, Australia and elsewhere. Naturally occurring $Th^{232}$ is much more plentiful than $U^{238}$. In addition there are approximately 100,000 metric tons of spent fissile material, rich in non-fissionable $U^{238}$, stored worldwide at about 400 nuclear power plants. This material waste can be used as fuel in the electrostatic voltage excitation process to produce the energy equivalent of ~375 billion barrels of oil.

Two fuels currently in use in the generation of fission power are $U^{235}$ and $Pu^{239}$. The former has a natural abundance of 0.711%. A uranium fuel rod must be enriched to about 3% $U^{235}$ in order for it to be useful in the generation of fission energy. $Pu^{239}$ does not occur in nature, but it may be produced from $U^{238}$, as mentioned in Appendix A, Eq. A-25. A typical fission reactor releases $8.20 \times 10^{10}$ joules for one gram of fissioned $U^{235}$. This value is based on the fact that the fission of one $U^{235}$ atom yields 200 MeV. By comparison, the total energy released in the alpha and beta decay of $U^{238}$ to $Pb^{206}$ is $2.245 \times 10^{10}$ joules, as calculated in Table 1.

Question

Now consider a fresh fission rod consisting of 97% $U^{238}$ and 3% $U^{235}$. What is the ratio of available alpha and beta energy to the available fission energy?

Answer

From Tables 1 and 1A, we have

Alpha-beta energy: $0.97\ (2.245 \times 10^{10}) + 0.03\ (1.88 \times 10^{10}) = 2.23 \times 10^{10}$ joules Fission energy: $0.03\ (8.20 \times 10^{10}) = 0.246 \times 10^{10}$ joules Ratio: 9.08

This value is based on the assumption that all of the $U^{235}$ is consumed in the fission process. Actually, in burner reactors, once the $U^{235}$ reaches a reduced value of about 1.5%, the rod is enriched back to 3%. This increases the foregoing ratio by a factor of two. Hence, the ratio of available alpha-beta energy to the available fission energy in a burner reactor rod is 18.16. This difference between the two processes is of major significance.

III-B. Alpha Power Compared to Fission Power

When an alpha emitter, like $U^{238}$ or $Th^{232}$, is placed inside the high voltage terminal of an electrostatic generator, the lifetime of the nucleus is changed from its natural value $\tau_0$ to a new value $\tau$, which is shorter or longer than $\tau_0$ depending on the polarity of the voltage. The expression which describes the Coulomb barrier modification process for alpha decay is $$\ln \tau/\tau_0 = 3.71Z((E-V)^{-\frac{1}{2}} - E^{-\frac{1}{2}}) \quad (1)$$

$$\text{The potential energy } V = +2|e\phi| \quad (2)$$

where $\phi$ is the terminal voltage on the electrostatic generator. In Eq. (1), E is the alpha particle energy, Z is the atomic number of the daughter and 3.71 is a parameter chosen to fit the natural lifetime data.

$$\begin{aligned} &\text{When } \phi=0,\ \tau=\tau_0 \\ &\text{When } \phi<0,\ \tau<\tau_0 \\ &\text{When } \phi>0,\ \tau>\tau_0 \end{aligned} \quad (3)$$

A practical choice of lifetime for $U^{238}$ and $Th^{232}$ fuel is 25 years. What value of $\phi$ is required for each of these fuels? The design equations are (1) and (2). To solve for $\phi$, it is convenient to use the abbreviations $$A = \ln \tau/\tau_0$$

$$B = 3.71Z$$

$C=1/E^{\frac{1}{2}}$ $$x=1/(E-V)^{\frac{1}{2}}=A/B+C \quad (4)$$

$$\text{Then } E-V=1/x^2 \quad (5)$$

$$\text{and } \phi=\left(\frac{E-x^{-2}}{2}\right)MV \quad (6)$$

The appropriate values for $U^{238}$ and $Th^{232}$ are given in Table 3.

TABLE 3

| Nuclide | Excitation voltage required for a 25 year lifetime of U238 and Th232 fuels | | | | | | | |
|---|---|---|---|---|---|---|---|---|
| | $\tau_0$ | A | B | E(MeV) | C | x | $\phi$ (kV) | $\tau$ |
| $_{92}U^{238}$ | $1.507 \times 10^9$ y | −17.9 | 333.9 | 4.268 | 0.484 | 0.426 | −621 | 25 y |
| $_{90}Th^{232}$ | $2.034 \times 10^9$ y | −20.52 | 326.9 | 4.081 | 0.495 | 0.432 | −639 | 25 y |

For each of these fuels, a voltage of ~−630 kV will change the natural lifetime to an excited lifetime of ~25 years. The average power produced by one metric ton of $U^{238}$ for 25 years by alpha, beta and gamma depletion is 28.48 MW. The corresponding value for one metric ton of $Th^{232}$ is 23.68 MW. These values follow from the total energy values given in joules for the decay of $U^{238}$ and $Th^{232}$ to stable isotopes of lead in Tables 1 and 2.

Question

The existing fission burner and breeder reactors generate electrical energy at a power level of ~300–350 megawatts. How much $U^{238}$ or $Th^{232}$ fuel would produce 350 MW?

Answer $U^{238}$ 12.32 metric tons
$Th^{232}$ 14.76 metric tons

For a 25 year lifetime, 4% of the fuel would have to be replaced each year.

Question

What is the theoretical and experimental evidence which establishes the validity of Eqs. (1)–(6) inclusive?

Answer

The theory of natural alpha decay is well established on both theoretical and experimental grounds. The derived lifetime expression is given by Eq. (A-7) in Appendix A. This relationship is $$\ln \tau_0=3.71Z/E^{\frac{1}{2}}-3.69Z^{\frac{2}{3}}-66.6 \quad (7)$$

where $\tau_0$ is the natural lifetime in years, E is the alpha energy MeV and Z is the atomic number of the daughter nucleus. This equation fits the lifetime-energy-atomic number data for alpha emitters very well.

The theory of accelerated alpha decay due to electrostatic voltage excitation is the essential feature of this and of the U.S. patent application Ser. No. 112,854. It is discussed in detail in Appendices B and C along with supporting experimental data.

$$\ln \tau=3.71Z/(E-V)^{\frac{1}{2}}-3.69Z^{\frac{2}{3}}-66.6 \quad (8)$$

Eq. (1) is a convenient formula, which is easily obtained by subtracting (8) from (7). Quantitative experimental evidence for this effect is given for $Th^{230}$ and other nuclides in Appendices B and C.

Thorium 230 has a natural half-life $T_{\frac{1}{2}}$ of 75,400 years. This isotope decays to $Pb^{206}$ through a chain of seven alphas and four beta minuses. In a test run, a $Th^{230}$ source underwent electrostatic voltage excitation for twelve hours at ~−400 kV. After the generator was turned off, the radiation count decayed to background in about six weeks. It has remained stable at background for six months. In the $Th^{230}$ decay chain there are three relatively long lived alpha decays and one twenty-one year beta decay. Evidently this excitation process removed all the alpha and beta activity in the $Th^{230}$ source in a time which is extremely short in comparison with 75,400 years. Similar results were observed in the accelerated alpha decay of $Po^{210}$.

Question

What is the excitation lifetime $\tau$ for $Th^{230}$ at four operating voltages? $\phi=\pm250$ kV and $\phi=\pm500$ kV?

Answer

The results are given in Table 4. These are obtained from Eq. (1) using $\tau_0=7.54\times10^4$y, Z=88, and E=4.658 MeV. The parameters for $Th^{230}$ are given in reference A-1, p. B-423. The energy value is a weighted average of the four values given in this reference.

TABLE 4

| The lifetime of $Th^{230}$ for four applied voltages | | | |
|---|---|---|---|
| $\phi$ | $\tau$ | $\phi$ | $\tau$ |
| −250 kV | 40.78 y | +250 kV | $5.26 \times 10^8$ y |
| −500 kV | 22.7 d | +500 kV | $2.10 \times 10^{13}$ y |

The lifetime depends exponentially on the polarity and magnitude of the excitation voltage. Theory predicts and experiment confirms that the rate of alpha decay is extremely sensitive to voltage control. This voltage is the homogeneous excitation potential in the cavity of a charged electrostatic generator, such as a Van de Graaff generator.

Question

Is beta decay accelerated by electrostatic voltage excitation? What is the experimental evidence and is there a theory which accounts for this effect?

Answer

An electrostatic voltage excitation experiment on several beta emitters is described in Appendix D. One of these is $Tl^{204}\beta-Pb^{204}$, $T_{178}=3.78$y. The others are six beta minus emitters in the $Th^{230}$ decay chain. The $Pb^{210}\beta-Bi^{210}$ lifetime is the longest of these: $T_{178}=21$y (see Table 3). All alpha and beta activity decayed appreciably about six weeks after the excitation. The principal depletion may take place during the excitation time, which in this case was twelve hours. This means that the beta decay lifetime was decreased by a factor of 365. This is substantial, but it is considerably less than the alpha lifetime reduction factor for $Th^{230}$ which was $1.31 \times 10^6$. The theoretical explanation for this observed accelerated beta decay is qualitative. It is not as well understood as the theory for accelerated alpha decay.

Consider atomic electrons in a beta minus emitter like $_{81}Tl^{204}$ and $_{82}Pb^{210}$. The electrons occupy energy shells. They are easily ionized, given a suitable excitation, as in the photoelectric effect. The first two ionization potentials for Tl and Pb are 6.12, 20.3 eV and 7.42 and 15.0 eV, respectively. Each atomic electron acquires an increased potential energy $|e\phi|$, if it is located inside a Van de Graaff cavity charged to a negative potential $\phi$. At $\phi = -350$ kV for example, many of the electrons will be excited to ionization states. They are not accelerated inside the cavity, which is field free. Electrons near the surface of the sample may drift towards the surface of the terminal. However, the majority will remain inside the source volume. This cloud of "free" electrons is similar to the "free" electrons in a metal. It is well known that the Knight shift in the NMR frequency in metals is due to an electron density $\psi^*\psi$ (0) at the nucleus, which is greater than for non-metals.

It is believed that the mechanism for the observed increase in beta decay rates is that $\psi^*\psi$ (0) is increased as the atomic electrons are ionized. The electron density at the nucleus is a crucial parameter in the theory of beta decay, as discussed in Appendix A, Section I-C. A more detailed discussion of accelerated beta decay is given in Appendix D.

Question

Is gamma decay accelerated by electrostatic voltage excitation?

Answer

The answer is yes. An experiment on the gamma source $Am^{241}$ demonstrates that electrostatic voltage excitation produces accelerated decay. A homogeneous negative electrostatic voltage excitation will decrease the potential energy of each proton in the atomic nucleus, just as it decreases the potential energy of an alpha particle. The charge distribution and shape of the nucleus will be disturbed and the gamma half-life will be changed. Negative voltages increase the gamma decay rate, positive voltages decrease the gamma decay rate. This was observed on a $Cs^{137}$ gamma source.

III-C. Conversion from Fission Power to Alpha Power

The conversion of existing nuclear fission plants to alpha, beta and gamma reactors is quite simple in principle. The essential change is the replacement of the fission reactor core with an alpha, beta and gamma reactor core. The fission reactor cores usually use water as a coolant. The heat generated in the nuclear process is passed to the coolant which circulates through pipes totally enclosed in the reactor vessel. This fluid is conveyed to a heat exchanger where water in a secondary loop is converted to steam. The steam drives a turbine or other load which generates electricity. A schematic drawing is given in FIG. 3.

Figure 3:
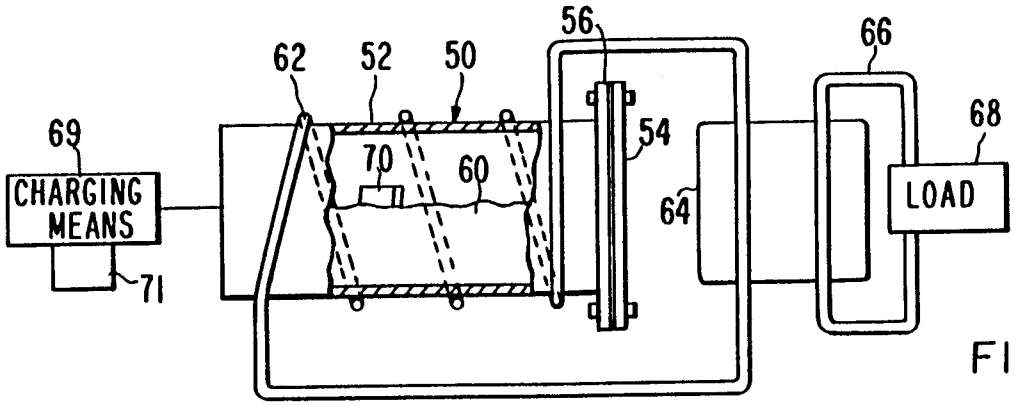
FIG. 3 is a schematic view, partly in section of an electrostatic generator with a coolant coil surrounding the same for generating power as heat energy which is transferred to the coolant in the coil and into a heat exchanger for providing power to a load coupled to the generator.

In FIG. 3, an electrostatic generator 50 has a cylindrical, hollow body 52 provided with an open end which is covered by an end plate 54 and secured in place to an annular flange 56 surrounding the open end of the body 52. Means 58 with control 71 is provided for charging the generator 50 to an electrostatic potential, such as in the range of 50 kV to 5,000 kV.

The body 52 is provided with a mass 60 of radioactive material which is to be used in generation of power by application of an electrostatic potential to the radioactive materials.

As the particle decay increases, a coolant flowing through an outer coil 62 surrounding body 52 carries heat energy to a heat exchanger 64 which transfers heat to another fluid in a closed loop 66 coupled with a load 68 to be driven by the energy imparted to the coolant in coil 62 by particle decay.

The numeral 70 in FIG. 3 represents a mass of a beta emitter which is used with generator 50 to provide sufficient electrons to cancel out the positive charges delivered by the alpha emitter 60 of the radioactive materials in the generator 50. A discussion of this feature follows hereinafter.

In the typical fission reactor, there are about 180 fuel assemblies each consisting of about 200 fuel rods. Each rod consists of $UO_2$ pellets 5 mm in diameter and 10 mm long, inserted in a thin walled stainless steel tube. This tube is referred to as cladding. It keeps the fission products from getting into the coolant water. Each fuel assembly weighs 545 kg. The total weight of the complete fission power assembly is about 98.1 metric tons. Fission power is activated by thermal neutrons. Control rods made of Boron 10 or Cadmium 113, with high neutron capture cross sections are used to maintain the desired power level. If the control rods are lowered into the assembly, the power level decreases. If they are raised, the power level increases.

In the alpha reactor it is not necessary to use as much fuel as in the fission reactor. This is because the alpha energy stored in a rod consisting of 97% $U^{238}$ and 3% $U^{235}$ is about 8.46 times greater than the potential fission energy, as explained earlier. Twenty-four assemblies, each consisting of 200 spent fission fuel rods will suffice. The total weight is about 13.1 metric tons. Alpha, beta and gamma power is activated by an electrostatic generator 50 (FIG. 3). The fuel assemblies are loaded in the cavity of the high voltage terminal. Control is maintained by the polarity and magnitude of the DC voltage on the generator terminal. A negative voltage increases the alpha power. A zero voltage shuts the power off, but not completely. There is a low level of oscillating power production which may persist for a few weeks.

This may be damped out by a positive voltage. If the voltage is set at about $-630$ kV, the lifetime of both $U^{238}$ and $Th^{232}$ fuel is about 25 years. When the total fuel weight is 13.1 metric tons, the power generated is about 373 MW for $U^{238}$ and about 310 MW for $Th^{232}$.

The interior volume of a conventional electrostatic generator 50 (FIG. 3) can easily accomodate 13 metric tons of $U^{238}$ or $Th^{232}$. The density of $UO_2$ and of $ThO_2$ is 10.96 and 9.86 gm/cm$^3$ respectively. The National Electrostatics Co. electrostatic generator, Pelletron Model 5SDH-2, is equipped with an accelerator tank which is 3.71 m in length and 1.07 m in diameter. The corresponding volume is 3.34 m$^3$, which is about 2.5 times the volume of the fuel.

III-D. Conclusion

1. Spent nuclear fission rods and naturally occurring $U^{238}$ and $Th^{232}$ are rich in energy.

2. The energy content of a spent nuclear fission rod is more than nine times greater than the fission energy of a fresh fuel rod, enriched with 3% $U^{235}$.

3. Electrostatic voltages change alpha, beta and gamma lifetimes so that power can be obtained from these sources.

4. A negative voltage accelerates alpha decay. A positive voltage decelerates alpha decay. The lifetime of $U^{238}$ and $Th^{232}$ is decreased from billions of years to 25 years by an electrostatic voltage of about −630 kV.

5. Conventional fission power reactors can be replaced by alpha power reactors. State of the art electrostatic generators have cavity volumes which can easily accomodate 13.1 metric tons of radioactive waste. Operating at −630 kV, they would generate over 370 MW, requiring 4% fuel replacement annually.

6. The best candidate for the coolant fluid is water.

7. The power level in an alpha reactor can be controlled by controlling the polarity and magnitude of the voltage. The power output will increase with the magnitude of the negative voltage. A positive voltage can be used to quench the activity. Voltage in an alpha, beta and gamma reactor plays a role similar to the control rods in a fission reactor.

8. The byproducts of an alpha reactor are helium and lead, which are both stable. The process removes all of the radioactive nuclei.

IV. Fusion Power

The deuteron-deuteron fusion process complements the alpha decay process. Both occur by Coulomb barrier modification.[2]

2 See reference A-2, Gasiorowicz, p. 93 and M. G. Bowler, *Nuclear Physics*, Pergamon Press, Oxford, 1973 p. 272 and 322.

The electrostatic voltage excitation process is capable of inducing Coulomb barrier penetration by deuterons at low ambient temperatures. The theory of this effect and its experimental verification with small samples of water is given in Appendix E.

IV-A. Fusion by Voltage Excitation as Compared to Fusion by Thermal Excitation As described in Appendix E, deuteron-deuteron fusion in a drop of water was induced by a voltage of ~−1 kV, at T=300° K. The water showed no activity prior to voltage excitation. After excitation, the Geiger counter detected an activity as high as thirty times background. The drop evaporated completely in one hour. After the voltage was switched off, the count continued substantially above background for about two hours.

According to conventional wisdom[3], the essential condition for nuclear fusion is a high temperature. In fact, this is a sufficient condition but it is not necessary.

3 Edward Teller, *Fusion*, Academic Press, New York (1981) p. 3; Samual Glasstone and Ralph H. Lovberg, *Controlled Thermonuclear Reactions*, Robert E. Krieger Publishing Co., Malabar, Fla. (1975) p. 14 and 18; and H. Motz, *The Physics of Laser Fusion*, Academic Press, London (1979) p. 1 and p. 224.

It is important to note the temperature equivalent of one electron volt.

$$T = \frac{1eV}{k} = 1.16 \times 10^{4\circ}\ \text{K}. \tag{11}$$

where $e=1.602\times10^{-19}$ coulomb and $k=1.381\times10^{-23}$ joules/°K. This means that 1000 eV is equivalent to $1.16\times10^{7\circ}$ K., which is well within the thermonuclear range. Extremely high temperatures occur in stellar interiors and in hydrogen bomb explosions, where fusion takes place. This is the reason attention has been focused on temperatures in excess of $10^{6\circ}$ K. Fusion by voltage excitation represents a completely different and essentially new approach.

IV-B. Dependence of Fusion Fuel Lifetime on Electrostatic Excitation Voltage The theoretical expression (see Appendix E) for the deuteron-deuteron fusion lifetime by voltage excitation is $$\tau=\tau_o e^G=3.64 \text{ hours for the D-D reaction at 60 KeV (for example) with } n_D=10^{15}\text{cm}^{-3} \tag{12}$$

and $$G=\pi\alpha(2\,\mu c^2/|e\phi|)^{\frac{1}{2}} \tag{13}$$

Here $\alpha$=the fine structure constant=1/137, $\mu c^2$=931.022 MeV and $|e\phi|$ is the excitation energy. For a given lifetime $\tau$, the corresponding excitation voltage may be calculated from, $$e\phi = 2\mu c^2\left(\pi\alpha/\ln\frac{(\tau)}{(\tau_o)}\right)^2, \tag{14}$$

an expression which follows immediately from (12) and (13).

Question

The excitation voltage required for a 25 year lifetime for deuteron fuel is −129 volts as compared to −630 kV for $U^{238}$ and $Th^{232}$. Why is there such a large difference?

Answer

The probability for a deuteron or an alpha particle to penetrate the Coulomb barrier is proportional to the Gamow factor, $T^*T=e^{-G}$. The G value is much smaller for deuteron fusion than for alpha decay. Therefore, the excitation voltage requirement for a given lifetime for fusion is much lower than it is for alpha decay. This point is clarified by comparing the maximum Coulomb barrier heights for these two processes. See Table 6.

TABLE 6

Barrier heights for deuteron-deuteron fusion and U238 alpha decay

| Process | Barrier height formula | Nuclear radius | Maximum Coulomb barrier height |
|---|---|---|---|
| D-D fusion | $e^2/2R$ | $1.77\times10^{-13}$ cm | 0.406 MeV |
| $U^{238}$ alpha decay | $2Ze^2/R$ | $8.68\times10^{-13}$ cm | 28.92 MeV |

IV-C. The Energy Content in Deuterium Fuel

The deuteron-deuteron reaction equations are well known.[4]

4 See reference 3, Glasstone and Lovberg, p. 15.

The primary reactions are $$_1D^2 + {}_1D^2 \rightarrow \underset{(0.82\text{ MeV})}{_2He^3} + \underset{(2.45\text{ MeV})}{_0n^1} \tag{15}$$

-continued $$\text{and } {}_1D^2 + {}_1D^2 \rightarrow \underset{(1.01\ \text{MeV})}{{}_1T^3} + \underset{(3.02\ \text{MeV})}{{}_1H^1} \quad (16)$$

These are known as the neutron branch and the proton branch, respectively, of the D-D reaction. In this fusion process the neutrons will escape from the reacting system and deposit their energy elsewhere. Only the energy of the charged particles may be used to generate electricity and this amounts to 4.85 MeV. In secondary reactions, deuterons interact with the $He^3$ found in the neutron branch and with the tritium found in the proton branch.

$$ {}_1D^2 + {}_2He^3 \rightarrow \underset{(3.6\ \text{MeV})}{{}_2He^4} + \underset{(14.7\ \text{MeV})}{{}_1H^1} \quad (17)$$

$$ {}_1D^2 + {}_1T^3 \rightarrow \underset{(3.5\ \text{MeV})}{{}_2He^4} + \underset{(14.1\ \text{MeV})}{{}_0n^1} \quad (18)$$

These four reactions yield 26.65 MeV of usable energy. If a lithium moderator is used to slow down the neutrons, the resulting thermal neutrons can be captured by $Li^6$ with a further release in energy.

$$ {}_3Li^6 + {}_0n^1 + {}_2He^4 \rightarrow {}_1T^3 + 4.6\ \text{MeV} \quad (19)$$

Thus six deuterons release 31.25 MeV, which may be used to generate electricity. The tritium may be used again in a D-T reaction. The products of this series of fusion reactions are helium, hydrogen, neutrons and ~5.21 MeV of energy for each deuteron. Table 7 gives the energy content in deuterium.

TABLE 7

| The energy available in deuterium fuel | | | | |
|---|---|---|---|---|
| Energy/deuteron (without Li moderator) | Energy/deuteron (with Li moderator) | Energy/gm deuterons | Energy/gm $H_2O$ | Energy/gallon $H_2O$ |
| 4.447 MeV | 5.208 MeV | $2.508 \times 10^{11}$ joules | $8.36 \times 10^6$ joules | $3.74 \times 10^{10}$ joules |

The combustion of one gallon of gasoline yields about $1.255 \times 10^8$ joules. The deuteron fuel energy in one gallon of water is equivalent to about 300 gallons of gasoline.

IV-D. Nuclear Fusion Power Reactor Core Design

Question

If the lifetime of the fusion fuel is one month, corresponding to an excitation voltage $\phi = -158$ volts, how many liters of water are required to deliver a power level of 350 MW?

Answer

From Table 7, the energy content in one gallon of water is $3.740 \times 10^{10}$ joules. This is due to the deuterons in the water. There are three hydrogen isotopes ${}_1H^1$, ${}_1D^2$ and ${}_1T^3$. The proton is by far the most abundant, at 99.988%. The deuteron has a natural abundance of 0.015%. Tritium undergoes beta decay with a half-life of twelve years. The entries in the fourth and fifth columns of Table 9 are calculated from this natural abundance data. Using the fact that one gallon = 3.785 liters, it follows that the deuteron fusion energy content in one liter of water is $9.88 \times 10^9$ joules. The number of liters required for a given power level P and lifetime $\tau$ is given by the relation $$n = P\tau / 9.88 \times 10^9 = 9.18 \times 10^4 \text{ for } P = 350\ \text{MW and } \tau = 1\ \text{month} \quad (20)$$

Question

What design factors are appropriate for an effective fusion reactor?

Answer

Consider a fuel tank whose volume is 91.8 $m^3$ filled with $91.8 \times 10^3$ liters of ordinary water or sea water. This is the volume, for example of a cylinder 7.76 m in length and 3.88 m in diameter. The tank shell should be a good conductor like aluminum or steel. Fusion takes place when an excitation voltage of $\sim -158$ volts is applied to this surface.

A grounded pressure vessel surrounds the fuel tank. This accomodates the coolant fluid. Either of two coolants used in fission reactors could be used, helium gas or water. The coolant fluid transfers the heat generated in the fusion process to the heat exchanger, where water is converted into steam. The steam drives a turbine which generates electrical power. See FIG. 3.

The apparatus of FIG. 3 is suitable for use to provide power from the deuteron-deuteron fusion process. To this end, body 52 of generator 50 can be partially or completely filled with water and a charging means 58 operated to provide an excitation voltage in a certain range, such as 100 volts to 2,000 volts. A coil 62 provides a grounded pressure vessel surrounding body 52 of generator 50. The energy produced within body 52 will be carried by the coolant in coil 62 to the heat exchanger 64 where heat energy is provided to the fluid in loop 66 coupled to load 68. Charging means 58 has a means 71 for varying the polarity and magnitude of the voltage applied to body 52.

Question

How is power controlled in a fusion reactor?

Answer

Figure 4:
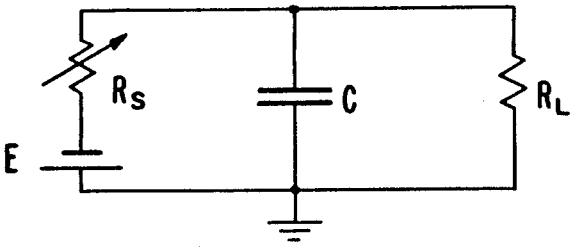
FIG. 4 is an equivalent circuit for controlling the deuteron-deuteron fusion process of the present invention.

The power level is controlled by varying the voltage on the surface of the fuel tank by control means 71. The electrostatic voltage excites the fuel inside the tank. If $\phi$ is negative and is increased in magnitude, the power level rises. If $\phi$ is turned to zero the power level exhibits transient oscillations which decay to background. They can be damped out by a positive voltage. An equivalent circuit may be used to represent control means 71. See FIG. 4.

For illustrative purposes, typical values are used for the emf, the source resistor $R_S$, the Capacitance C and the load resistor $R_L$.

IV-E. Radiation Hazards due to the Fusion Process

The deuteron-deuteron fusion process produces energy, helium, hydrogen and neutrons. The neutrons have energies of 2.45 and 14.1 MeV, (Eqs. 15 and 18). Water in the fuel and in the coolant acts as a moderator. This thermalizes the fast neutrons. These slow neutrons can be substantially reduced if the reactor core is lined with boron or cadmium. These materials have a high capture cross section for thermal neutrons.

It is not necessary to use heavy lead shielding to protect against harmful fusion radiation. This is why fusion energy is a practical source of power for all types of vehicles and of heat for homes and other stationary structures.

IV-G. Conclusion

1. Fresh water and salt water are rich in deuteron fusion energy.

2. Although the natural abundance of deuterium is only 0.015%, the fusion energy content of one gallon of water is equivalent to 300 gallons of gasoline.

3. Electrostatic voltage excitation induces D-D fusion by Coulomb barrier modification.

4. An electrostatic voltage of $\sim -158$ volts results in a fusion lifetime of ~one month.

5. The excitation voltages for a given fusion lifetime are small in comparison with those for accelerated alpha decay with the same lifetime because of the large difference in Coulomb barrier height.

6. A fusion power reactor capable of generating 350 MW requires $\sim 9\times 10^4$ liters of water and an excitation voltage $\sim -158$ volts. This reactor would deplete the deuterons in 3,000 liters per day, producing $9\times 10^4$ liters of "light water" in one month.

7. Water or helium can be used as the coolant fluid in fusion reactors. Water is preferable because it also serves as a moderator for energetic neutrons.

8. The low excitation voltages needed for fusion permit the use of DC generators or heavy duty batteries in the energizing circuitry. Charge compensation for the deuteron current is provided by a choice of load and source resistance values.

9. The control of fusion power levels is achieved by adjusting the excitation voltage.

10. The products of the deuteron-deuteron fusion process are energy, hydrogen, helium, light water, and neutrons.

11. Radiation problems due to D-D fusion can be minimized by using water as a moderator to slow the fast neutrons, and cadmium or boron to capture the thermalized neutrons.

12. Fusion reactors may be used to generate electrical, mechanical or heat energy on a large scale, as in a 350 MW power plant, or on a small scale, as in a vehicle or a home. The design is simply a scaled down version of the design for a large fusion power reactor.

13. Controlled fusion experiments have been done a number of times in a small Van de Graaff generator with a small quantity of water, as described in Appendix E. Substantial counting above background is observed several feet from the water, when the generator is turned on. The water may evaporate.

14. Agreement between theory and experiment in the fusion process, induced by electrostatic voltage excitation is qualitative, not quantitative.

V. Production of Valuable Products by Transmutation, using Electrostatic Voltage Excitation V-A. General Considerations Electrostatic voltage excitation accelerates or induces decay. The decay energy Q, of a nuclide which disintegrates spontaneously, is positive. The process is exothermic and occurs with a lifetime $\tau$, which ranges from microseconds to billions of years depending on Q and the charge of the daughter nucleus. Electrostatic voltage excitation changes the potential energy of alpha particles, protons, and atomic electrons. This has an exponential effect on the lifetime of alpha emitters and a substantial effect on the lifetime of beta and gamma emitters. This is discussed in Appendices B and C and in Section III-B of this patent application.

The decay energy Q, of a nuclide which is stable against alpha decay is negative. The process is endothermic. No spontaneous decay occurs. Electrostatic voltage excitation with a potential energy $|V|>|Q|$ will induce decay with a lifetime $\tau$, which for alpha decay decreases as the magnitude of the negative voltage increases. The weak interaction decay rate is also increased, but not exponentially as it is in alpha decay.

The voltage required to induce decay is in the MW range. This is readily available in standard research electrostatic generators. If the sample is small enough, the generator's charging current of ~200 microamps will suffice to maintain a few million volts on the terminal. For larger samples of alpha emitters, the positive alpha current can be offset if a sufficiently large beta minus source is introduced into the generator cavity. If this is not done, the negative charge on the terminal will become neutralized, the negative potential will decrease in magnitude, and the generator motor will heat up due to the overload. Electrostatic generators are designed to switch off if they become overheated.

Nuclear chemistry is greatly simplified by the use of isotope charts like the one exhibited in Table 11. The construction of a decay scheme is straightforward, and it leads from a stable and inexpensive isotope to a valuable isotope by successive induced or spontaneous alpha and beta minus decays.

TABLE 7

An Isotope Chart for Nuclear Chemistry

| | | | Pt Metals | | |
|---|---|---|---|---|---|
| A | B | C | D | E | F |
| 1 | 74 W 173–184 | 75 Re 177–192 | 76 Os 181–195 | 77 Ir 182–198 | 78 Pt 173–200 |
| 2 | | | | | |
| 3 | 173 | | | | 173 |
| 4 | 174 | | | | 174 |
| 5 | 175 | | | | 175 |
| 6 | 176 | | | | 176 |
| 7 | 177 | 177 | | | 177 |
| 8 | 178 | 178 | | | 178 |
| 9 | 179 | 179 | | | 179 |
| 10 | 180 | 180 | | | 180 |

TABLE 7-continued

An Isotope Chart for Nuclear Chemistry

| | | | | | | | | | | |
|---|---|---|---|---|---|---|---|---|---|---|
| 11 | | 181 | | 181 | | 181 | | | | 181 |
| 12 | 26.14% | 182 | | 182 | | 182 | | 182 | | 182 |
| 13 | 14.40% | 183 | | 183 | | 183 | | 183 | | 183 |
| 14 | 30.64% | 184 | | 184 | 0.018% | 184 | | 184 | | 184 |
| 15 | beta- | 185 | 37.50% | 185 | | 185 | | 185 | | 185 |
| 16 | 28.41% | 186 | | 186 | 1.59% | 186 | | 186 | | 186 |
| 17 | | 187 | 62.50% | 187 | 1.64% | 187 | | 187 | | 187 |
| 18 | | 188 | | 188 | 13.3% | 188 | | 188 | | 188 |
| 19 | | 189 | | 189 | 16.1% | 189 | | 189 | | 189 |
| 20 | | | | 190 | 26.4% | 190 | | 190 | 0.127% | 190 |
| 21 | | | | 191 | beta- | 191 | 37.4% | 191 | | 191 |
| 22 | | | | 192 | 39.95% | 192 | | 192 | 0.78% | 192 |
| 23 | | | | | | 193 | 62.4% | 193 | | 193 |
| 24 | | | | | | 194 | | 194 | 32.9% | 194 |
| 25 | | | | | | 195 | | 195 | 33.8% | 195 |
| 26 | | | | | beta- | 196 | | 196 | 25.3% | 196 |
| 27 | | | | | | | | 197 | beta- | 197 |
| 28 | | | | | | | | 198 | 7.21% | 198 |
| 29 | | | | | | | | | | 199 |
| 30 | | | | | | | | | | 200 |
| 31 | | | | | | | | | | |
| 32 | | | | | | | | | | |
| 33 | | | | | | | | | | |
| 34 | | | | | | | | | | |
| 35 | | | | | | | | | 1.48% Pb | 204 |
| 36 | | | | | | | | | 23.1% Hb | 200 |
| 37 | | | | | | | | | 25.3% Pt | 196 |
| 38 | | | | | | | | | zero % Au | 196 |
| 40 | | | | | | | | | 1.46% Hg | 196 |
| 41 | | | | | | | | | | |
| 42 | | | | | | | | | | |
| 43 | | | | | | | | | | |
| 44 | | | | | | | | | | |
| 45 | | | | | | | | | | |

Pt Metals

| | G | H | I | J | K |
|---|---|---|---|---|---|
| 1 | 79 Au 185–203 | 80 Hg 1850296 | 81 Tl 1910210 | 882 Pb 194–214 | 83 Bi 199–215 |
| 2 | | | | | |
| 3 | | | | | |
| . | | | | | |
| . | | | | | |
| . | | | | | |
| . | | | | | |
| 14 | | | | | |
| 15 | | 185 | 185 | | |
| 16 | | 186 | 186 | | |
| 17 | | 187 | 187 | | |
| 18 | | 188 | 188 | | |
| 19 | | 189 | 189 | | |
| 20 | | 190 | 190 | | |
| 21 | | 191 | 191 | 191 | |
| 22 | | 192 | 192 | 192 | |
| 23 | | 193 | 193 | 193 | |
| 24 | | 194 | 194 | 194 | 194 |
| 25 | | 195 | 195 | 195 | 195 |
| 26 | beta- | 196 | 0.146% | 196 | 196 | 196 |
| 27 | 100% | 197 | 197 | 197 | 197 | 197 |
| 28 | | 198 | 10.2% | 198 | 198 | 198 |
| 29 | | 199 | 16.84% | 199 | 199 | 199 | 199 |
| 30 | | 200 | 23.13% | 200 | 200 | 200 | 200 |
| 31 | beta- | 201 | 13.22% | 201 | 201 | 201 | 201 |
| 32 | | 202 | 29.80% | 202 | 202 | 202 | 202 |
| 33 | | 203 | beta- | 203 | 29.50% | 203 | 203 | 203 |
| 34 | | | 6.85% | 204 | | 204 | 1.48% | 204 | 204 |
| 35 | | | | 205 | 70.50% | 205 | | 205 | 205 |
| 36 | 100% Bi | | | 206 | | 206 | 23.6% | 206 | 206 |
| 37 | 70.5% Tl 205 | | | | | 207 | 22.6% | 207 | 207 |
| 38 | zero % Au 201 | | | | | 208 | 52.3% | 208 | 208 |
| 39 | 13.2% Hg 201 | | | | | 209 | | 209 | 100% | 209 |
| 40 | zero % Pt 197 | | | | | 210 | | 210 | 210 |
| 41 | 100% Au 197 | | | | | | | 211 | 211 |
| 42 | | | | | | | | 212 | 212 |
| 43 | | | | | | | | 213 | 213 |
| 44 | | | | | | | | 214 | 214 |
| 45 | | | | | | | | | 215 |

Rh Metals

| | A | B | C | D | E | F |
|---|---|---|---|---|---|---|
| 1 | 42 Mo 88–105 | 43 To 93–107 | 44 Ru 96–108 | 45 Rh 97–110 | 46 Pd 98–115 | 47 Ag 102–117 |

TABLE 7-continued

An Isotope Chart for Nuclear Chemistry

| | | | | | | |
|---|---|---|---|---|---|---|
| 2 | | | | | | |
| 3 | 88 | | | | | |
| 4 | 89 | | | | | |
| 5 | 90 | | | | | |
| 6 | 91 | | | | | |
| 7 | 92 | 92 | | | | |
| 8 | 93 | 93 | | | | |
| 9 | 94 | 94 | | | | |
| 10 | 95 | 95 | | | | |
| 11 | 96 | 96 | 96 | | | |
| 12 | 97 | 97 | 97 | 97 | | |
| 13 | 98 | 98 | 98 | 98 | 98 | |
| 14 | 99 | 99 | 99 | 99 | 99 | |
| 15 | 100 | 100 | 100 | 100 | 100 | |
| 16 | 101 | 101 | 101 | 101 | 101 | |
| 17 | 102 | 102 | 102 | 102 | 102 | 102 |
| 18 | 103 | 103 | 103 | 103 | 103 | 103 |
| 19 | 104 | 104 | 104 | 104 | 104 | 104 |
| 20 | 105 | 105 | 105 | 105 | 105 | 105 |
| 21 | | 106 | 106 | 106 | 106 | 106 |
| 22 | | 107 | 107 | 107 | 107 | 107 |
| 23 | | | 108 | 108 | 108 | 108 |
| 24 | | | | 109 | 109 | 109 |
| 25 | | | | 110 | 110 | 110 |
| 26 | | | | | 111 | 111 |
| 27 | | | | | 112 | 112 |
| 28 | | | | | 113 | 113 |
| 29 | | | | | 114 | 114 |
| 30 | | | | | 115 | 115 |
| 31 | | | | | | 116 |
| 32 | | | | | | 117 |
| 33 | | | | | | |
| 34 | | | | | | |
| 35 | | | | | | |
| 36 | | | | | | |
| 37 | | | | | | |
| 38 | | | | | | |
| 39 | | | | | | |
| . | | | | | | |
| . | | | | | | |
| . | | | | | | |

| | | Rh Metals | |
|---|---|---|---|
| | G | H | I |
| 1 | 48 Cd 103–119 | 49 In 106–124 | 50 Sn 108–133 |
| 2 | | | |
| 3 | | | |
| . | | | |
| . | | | |
| . | | | |
| 16 | | | |
| 17 | | | |
| 18 | 103 | | |
| 19 | 104 | | |
| 20 | 105 | | |
| 21 | 106 | 106 | |
| 22 | 107 | 107 | |
| 23 | 108 | 108 | 108 |
| 24 | 109 | 109 | 109 |
| 25 | 110 | 110 | 110 |
| 26 | 111 | 111 | 111 |
| 27 | 112 | 112 | 112 |
| 28 | 113 | 4.28% 113 | 113 |
| 29 | 114 | 114 | 114 |
| 30 | 115 | 95.72% 115 | 115 |
| 31 | 116 | 116 | 116 |
| 32 | 117 | 117 | 117 |
| 33 | 118 | 118 | 118 |
| 34 | 119 | 119 | 119 |
| 35 | | 120 | 120 |
| 36 | | 121 | 121 |
| 37 | | 122 | 122 |
| 38 | | 123 | 123 |
| 39 | | 124 | 124 |
| 40 | | | 125 |
| 41 | | | 126 |
| 42 | | | 127 |
| 43 | | | 128 |
| 44 | | | 129 |
| 45 | | | 130 |
| 46 | | | 131 |

TABLE 7-continued

| An Isotope Chart for Nuclear Chemistry | |
|---|---|
| 47 | 132 |
| 48 | 133 |
| 49 | |
| 50 | |

V-B. The Production of Rhodium from Silver

Consider $_{45}Rh^{103}$, a stable isotope of rhodium with a natural abundance of 100%. There is substantial demand for rhodium, which is used as an alloy to harden platinum and palladium, as a catalyst and in jewelry. The supply of rhodium is quite limited and it is the most valuable precious metal. Only about eight tons are produced annually worldwide. According to Skilling's Mining Review, Nov. 28, 1987, metal prices per ounce were: Silver, $6.88; Gold, $470.85; Platinum, $500.00; Rhodium, $1200.00.

Rhodium may be produced from the stable isotopes of silver by induced alpha decay.

$$_{47}Ag^{107}\ (51.84\%) \rightarrow {}_{45}Rh^{103} + {}_{2}He^{4}\ \text{Induced} \quad (20)$$

$$_{47}Ag^{109}\ (48.16\%) \rightarrow {}_{45}Rh^{105} + {}_{2}He^{4}\ \text{Induced} \quad (21)$$

$$_{45}Rh^{107} \rightarrow {}_{46}Pa^{105} + \beta^{-} + \nu\ \text{Spontaneous}\ T^{\frac{1}{2}} = 34.5\ \text{m}$$

$_{46}Pa^{105}$ has a $Q = -2.89$ Mev against a decay

Although both of the reactions (20) and (21) lead to rhodium, only the first is considered here. The second process leads to 46 $Pa^{105}$. Although beta decay is enhanced by electrostatic voltage excitation, not enough is known to be able to make design claculations. However, the design equations are available for induced alpha decay.

Quantitatively, the first step is to calculate the decay constants for the reactions which describe the production and decay of rhodium.

$$_{47}Ag^{107} \xrightarrow{\alpha} {}_{45}Rh^{103}$$

and $$_{45}Rh^{103} \xrightarrow{\alpha} {}_{43}Tc^{99} \quad (22)$$

These are found, as illustrated in Appendix A, Eq. A-17 by $$Q=(M_p-M_d-M_\alpha)c^2 \quad (23)$$

where $M_p$=mass of parent in amu, $M_d$=mass of daughter and $M_\alpha$=alpha particle mass. The results are $$Q_1=-2.802\ \text{MeV}$$

and $$Q_2=-3.1243\ \text{MeV}. \quad (24)$$

Both Q values are endothermic, with rhodium more stable against alpha decay than silver.

The second step is to choose an excitation voltage which results in a convenient lifetime. The theoretical formula (see Eq. (8) in Section III-B) is $$\ln \tau_1=3.71Z_1/E_1^{\frac{1}{2}}-3.69Z_1^{\frac{2}{3}}-66.6 \quad (35)$$

Here $E_1=Q_1+2|e\phi|$, $Z_1=45$ $\tau_1$ is in years and $E_1$ is in MeV. If 24 hours is chosen as the $Ag^{107}$ lifetime, the corresponding voltage is −2.61 MV.

The third step is to calculate $\tau_2$ using Eq. (25), but with $Z_2=43$, $E_2=-3.12+5.219=2.10$ MeV. The resulting $\tau_2=55$ days, which is large compared to $\tau_1$. Since the rhodium lifetime is much longer than that of the silver parent, the two decays are effectively decoupled; the first decay is finished before much happens in the second.[5]

[5] Bernard L. Cohen, Concepts of Nuclear Physics, McGraw Hill Book Co., New York, (1971), p. 198.

Fourth, calculate the rhodium yield starting with one kg of natural Ag after an excitation period of 24 hours. In this calculation only the more abundant isotope of Ag (51.8%) is considered.

Using the decay equation $$dN_1/dt=-N_1/\tau \quad (26)$$

it follows that $$N_1/N_0=e^{-1}\ \text{after t=24 hours} \quad (27)$$

The rhodium yield is $$(N_2-N_1)/N_0=(1-e^{-1})=63.21\% \quad (28)$$

with $N_0$=0.518 kg, the amount of rhodium synthesized in 24 hours is 327.4 gm.

V-C. The Production of Platinum from Mercury

Consider the stable isotopes of platinum. All of these are potential alpha decay daughters of stable isotopes of mercury. The Q values for each of these processes, calculated from Eq. (33) are given in Table 10.

TABLE 10

The Q Values for Platinum Production and Decay Processes

| Nuclear Processes | Natural Abundance of Parent (%) | Natural Abundance of Daughter (%) | Q (MeV) |
|---|---|---|---|
| (a) $_{80}Hg^{196} \xrightarrow{\alpha} {}_{78}Pt^{192}$ | 0.15 | 0.79 | 2.038 |
| $_{78}Pt^{192} \xrightarrow{\alpha} {}_{76}Os^{188}$ | 0.79 | 13.3 | 2.383 |
| (b) $_{80}Hg^{198} \xrightarrow{\alpha} {}_{78}Pt^{194}$ | 10.1 | 32.9 | 1.386 |
| $_{78}Pt^{194} \xrightarrow{\alpha} {}_{76}Os^{190}$ | 32.9 | 26.4 | 1.508 |
| (c) $_{80}Hg^{199} \xrightarrow{\alpha} {}_{78}Pt^{195}$ | 17 | 33.8 | 0.827 |
| $_{78}Pt^{195} \xrightarrow{\alpha} {}_{76}Os^{191}$ | 33.8 | $\beta-$, 15.4 d | 1.161 |
| (d) $_{80}Hg^{200} \xrightarrow{\alpha} {}_{78}Pt^{196}$ | 23.1 | 25.3 | 0.7210 |
| $_{78}Pt^{196} \xrightarrow{\alpha} {}_{76}Os^{192}$ | 25.3 | 41 | 0.800 |
| (e) $_{80}Hg^{202} \xrightarrow{\alpha} {}_{78}Pt^{198}$ | 29.65 | 7.2 | 0.1379 |

TABLE 10-continued

The Q Values for Platinum Production and Decay Processes

| Nuclear Processes | Natural Abundance of Parent (%) | Natural Abundance of Daughter (%) | Q (MeV) |
|---|---|---|---|
| $_{78}Pt^{198} \xrightarrow{\alpha} {}_{76}Os^{194}$ | 7.2 | $\beta-$, 6 y | 0.08942 |

Table 10 shows that 80% of the stable isotopes of mercury decay by induced emission to 100% of the stable isotopes of platinum. The Q values for the production and decay of platinum are all exothermic.

In Table 10, process a is unfavorable because it involves only a minute amount of mercury. Processes b, c and d in Table 10 pose difficulties because for any given voltage $\phi$, the platinum formed will decay much faster than the mercury. However, process e in Table 10 is favorable. $Hg^{202}$ has a natural abundance of 29.65%. The Q for platinum production is larger than the Q for platinum decay.

Consider a one kg sample of $Hg^{202}$. Choose $\tau_1=24$ hours. This fixes the values of $\phi$ and $\tau_2$ according to $$e\phi_1=(3.71Z_1)^2/2(\ln \tau_1+3.69Z_1^{\frac{2}{3}}+66.6)^2-Q^{\frac{1}{2}}, \quad (29)$$

and $$\ln \tau_2=3.71Z_2/E_2^{\frac{1}{2}}-3.69Z_2^{\frac{2}{3}}-6.66, \quad (30)$$

where $Z_1=78$, $Q_1=0.1374$ MeV, $Z_2=76$ and $E_2=2|e\phi|_1+Q_2$.

If at $t=0$, the mass of $Hg^{202}$ is $m_0=1$ kg, then after a time t the mass of $Pt^{198}$ will be $$m_2(t)/m_0 = \frac{\tau_2}{\tau_1 - \tau_2}(e^{-t/\tau_1} - e^{-t/\tau_2}). \quad (31)$$

This expression is well known[6] from the theory of radioactive decay.

[6] Reference 15, p. 187.

The percentage yield $Y(t)=m_2(t)/m_0$ is zero at $t=0$ and at $t=\infty$. Therefore, there is a value for the excitation time for which the yield is a maximum. Setting $dY(t)/dt=0$, it follows that $$t_{opt} = \frac{\tau_1\tau_2}{\tau_1 - \tau_2} \ln \frac{\tau_1}{\tau_2} \quad (32)$$

In Table 13, the parameters relating to the maximum yield of $Pt^{198}$ are listed.

TABLE 11

The Production of $PT^{198}$ from $Hg^{202}$

| Nuclear Processes | Q | $\tau_1$ | $\phi_1$ | $\tau_2$ | $t_{opt}$ | Yield |
|---|---|---|---|---|---|---|
| $_{80}Hg^{202} \xrightarrow{\alpha} {}_{78}Pt^{198}$ | 0.1379 | 24 h | −2.484 MV | | 35 h | 52.7% |
| $_{78}Pt^{198} \xrightarrow{\alpha} {}_{78}Os^{194}$ | 0.08942 | | | 53.94 h | | |

Hence, one kg of Hg202 will yield 527 grams of Pt198.

It is reasonable to assume that a more sophisticated scheme can be developed for the extraction of platinum from all of the stable isotopes of mercury.

V-D. The Production of Gold and of $_{80}Hg^{196}$

There is only one stable isotope of gold, and it may be synthesized from $_{80}Hg^{201}$ as follows.

(33)

| | |
|---|---|
| $_{80}Hg^{201} \xrightarrow{\alpha} {}_{78}Pt^{197}$ | Induced alpha decay |
| $_{78}Pt^{197} \xrightarrow{\beta-} {}_{79}Au^{197}$ | Spontaneous $\beta$- decay $T_{\frac{1}{2}}$ = 18.3 h |

Consider $_{80}Hg^{196}$, a stable isotope of mercury, with a low natural abundance of 0.146%. Although it is not as well known as rhodium, platinum or gold, it is considerably more valuable. A low pressure mercury vapor lamp is about 5% more efficient if the concentration of $_{80}Hg^{196}$ is enriched to about 4.4%. This modification does not require a significant change in the features of the fluorescent lamp. If all of the Hg-rare gas fluorescent lamps were enriched in this fashion[7], the energy saved in the United States would amount to $200,000,000.00.

[7] J. Maya et al, Science, (1984), pp. 226 and 435.

At the present time there is an effort being made at the Lawrence Livermore National Laboratories to produce $_{80}Hg^{196}$ by laser isotope separation. The synthesis of this isotope by electrostatic voltage excitation represents an alternate approach. A starting point in the production of $_{80}Hg^{196}$ is the $_{80}Hg^{200}$ isotope of mercury with a natural abundance of 23.1%.

(34)

| | |
|---|---|
| $_{80}Hg^{200} \xrightarrow{\alpha} {}_{78}Pt^{196}$ | Induced alpha emission |
| $_{78}Pt^{196} \xrightarrow{\beta-} {}_{79}Au^{196}$ | Induced beta emission |
| $_{79}Au^{196}$ $\beta$- $_{80}Hg^{196}$ | Induced beta emission |

Instead of exciting induced alpha and beta minus decay, it is possible to induce an appropriate fusion process.

| | |
|---|---|
| $_{42}Mo^{100} + {}_{42}Mo^{100}$ fusion $\rightarrow {}_{84}Po^{200} \xrightarrow{\alpha}$ $_{82}Pb^{196}$ | Induced fusion and spontaneous alpha decay |
| $_{82}Pb^{196}$ EC $_{81}Tl^{196}$ | EC and beta plus 11.5 m |
| $_{81}Tl^{196}$ EC $_{80}Hg^{196}$ | EC and beta plus 1.13 h |

The synthesis of $Hg^{196}$ is more likely by decay than by fusion. The fusion of $Mo^{100}$ requires an excitation voltage in excess of −77.6 MV. This is beyond the capability of state of the art electrostatic generators.

V-E. The Production of Other Valuable Isotopes

The examples given are illustrative, not comprehensive. The electrostatic voltage excitation process is available for the production of any valuable isotope which is important in industry, basic research or medicine. A decay scheme can be found which leads to such an isotope, starting with plentiful, relatively stable isotopes like $Bi^{209}$ (100%), $Pb^{204}$ (1.4%), $Pb^{206}$ (94.1%), $Pb^{207}$ (22.1%) and $Pb^{208}$ (52.4%). The specific path to use is facilitated by the charts given in Table 7.

V-F. Conclusion

1. Abundant relatively stable isotopes like lead, bismuth and mercury represent the starting point for the production of valuable isotopes.

2. Electrostatic voltage excitation induces alpha, beta and gamma decay and fusion, (for $Z \sim 1$). This is a transmutation process.

3. The induced decay lifetime depends on the Q of a given nuclear reaction and on the excitation voltage. The Q can be calculated from mass-energy considerations.

4. In most of the induced processes, the voltage is in the MV range. This is higher than for either fusion or accelerated alpha decay.

5. Examples of production by transmutation are rhodium, Pt198, gold and Hg196.

6. Attempts to synthesize valuable isotopes should be done initially with small samples and voltages which are less than optimal.

VI. Summary

A. The electrostatic voltage excitation process and apparatus of the present invention has four major applications; (1) Decontamination of radioactive waste, (2) Generation of alpha power as an economical substitute for fission power, (3) Generation of fusion power, (4) The production of valuable isotopes by transmutation.

B. The availability of the electrostatic excitation process represents a major scientific and technological advance with far reaching economic implications.

C. As with other significant technical developments, the implications of the electrostatic excitation process have encountered incredulity on the part of the scientific community.

D. According to conventional wisdom, the half-life of a radioactive source cannot be changed. It is immutable, like the charge on an electron or Planck's constant. Yet, nowhere in the literature is this assertion made.

E. The current situation has a parallel with an incident which took place in the 1950's. At that time scientists "knew" that noble gases like Ne, Xe, and Kr could not combine into molecules. When $XeF_4$ was synthesized at the Argonne National Laboratories, this myth was abandoned.

F. Electrostatic voltage excitation refers to the potential energy acquired by a charged particle when it is placed in a region of homogeneous potential and zero field. The potential energy $V=q\phi$, where q is the charge of the particle and $\phi$ is the potential.

Figure 6:
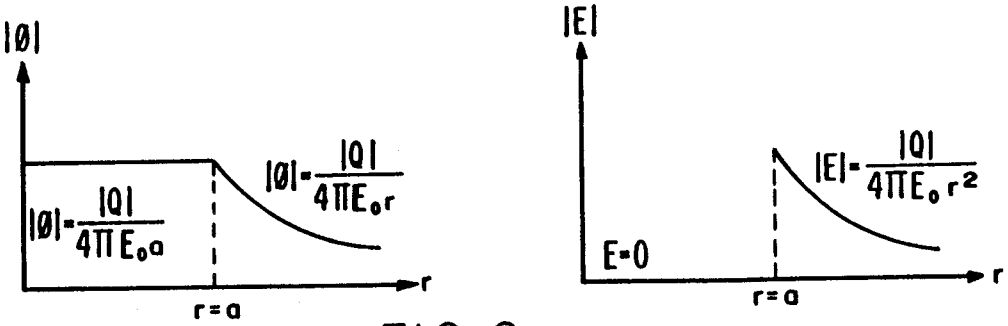
FIG. 6 is the electrostatic potential and field of the electrostatic generator as plotted as a function of distance r from the center of the hollow body of the generator at radius a carrying a surface charge Q.

G. The device which creates a constant potential, field free region is an electrostatic generator, like the Van de Graaff. It has a high voltage terminal which consists of a spherical or ellipsoidal metal shell, enclosing a cavity. Inside the cavity there is no net charge. By Gauss' theorem the cavity is field free and the potential is constant everywhere, the same from point to point. Outside the cavity, the potential and the field go to zero with increasing distance from the cavity center. Inside the cavity, a charged particle is not accelerated as there is no field, while outside the cavity a charged particle is accelerated, as there is a field. The potential and field, inside and outside a spherical cavity, are sketched in FIG. 6.

H. The cavity surface may be charged negatively or positively. Consider $\phi$ negative, corresponding to a negative charge delivered to the surface by the generator's belt system.

(1) The potential energy of an alpha particle decreases by $-2|e\phi|$. The total potential energy of an alpha particle in the interior of an alpha emitter is $2Ze^2/r-2|e\phi|$. This decrease in the Coulomb barrier results in accelerated decay. For a detailed theoretical treatment, see Appendix C.

(2) The potential energy of a deuteron is decreased by $-|e\phi|$. The total potential energy of a deuteron in water is $e^2/r-|e\phi|$. This decrease in the Coulomb barrier permits induced D-D fusion. See Appendix E.

(3) The potential energy of an electron is increased by $|e\phi|$. If $\phi > 10^3$ volts, the atoms in a beta emitter, for example, will experience several stages of ionization. As the region is field free, the electrons remain in the vicinity of the ions. This cloud of "free electrons" increases the charge density at the nucleus accelerating beta decay. The effect is quite similar to the Knight shift in metals, where the "free electrons" in the conduction band lead to a higher nuclear magnetic resonance frequency than is observed with the same nucleus in a non-metal.

(4) The potential energy of a proton is decreased by $-|e\phi|$. In a gamma emitter, for example, the protons in the nucleus undergo a redistribution of charge which changes the shape of the nucleus, inducing decay at a faster rate.

I. The lifetime for natural alpha decay is well known.

$$\ln \tau_0 = 3.71 Z_1/E^{\frac{1}{2}} - 3.69 Z_1^{\frac{2}{3}} - 66.6 \text{ Where } T_0 \text{ is in years} \quad (1)$$

and E is in MeV

Inside the cavity of an electrostatic generator with a negative voltage $\phi$, the lifetime becomes $$\ln \tau = 3.71 Z_1/(E+2|e\phi|)^{\frac{1}{2}} - 3.69 Z_1^{\frac{2}{3}} - 66.6 \quad (2)$$

J. Equation (2) describes the effect of Coulomb barrier modification on alpha decay. It is the central equation of this theory and is readily derived from $$\tau = \tau_{oo} e^G \quad (3)$$

where $e^{-G}$ is the Gamow barrier penetrability factor and $\tau oo$ is the mean lifetime it takes for an alpha particle to move back and forth inside the nuclear well.

K. Experimental evidence for the validity of Eq. (1) exists in the literature. Experimental evidence for the validity of Eq. (2) is presented in this patent application in Appendices B and C. The theory is confirmed for $_{90}Th^{230}$ and for $_{84}Po^{210}$ for voltages ranging from $-50$ kV to $-400$ kV.

L. Independent calibration before and after high voltage excitation has been made for $Th^{230}$ and $Po^{210}$. In both cases it was observed that the initial untreated alpha count decreased appreciably six weeks after excitation.

M. The experiment performed to test Eq. (2) demonstrated that $_{90}Th^{230}$ and all of its alpha and beta daughters decayed appreciably in about six weeks following a voltage excitation of $-400$ KV for twelve hours. $Th^{230}$ has a lifetime $\tau_o = 1.08 \times 10^5$y. This experiment showed that beta decay is also accelerated by the voltage excitation process. The beta emitter TI204 also decayed appreciably in the same time period.

N. The theory of accelerated beta and gamma decay is not understood quantitatively. This area needs further study.

O. Eqs. (1) and (2) are time independent. They describe natural and accelerated alpha decay. When the generator is turned off, $\phi=0$. There follows a reaction response which continues for days. This reaction mode is not understood, but it is similar to the transient decay which occurs following any type of excitation. The excitation process at high electrostatic voltage and the reaction process at zero voltage together lead to accelerated decay. For a more detailed discussion, see Appendix C.

P. When the Thorium 230 decays to lead, it releases energy as is well documented in the literature. If this release is accelerated, the power generation increases. This has not been directly tested experimentally.

Q. Decontamination and power generation by alpha, beta and gamma decay are practical applications of Eq. (2). See I. and K. of this section.

R. It is well known that alpha decay and controlled deuteron-deuteron fusion occur by Coulomb barrier penetration. The theory of Coulomb barrier modification for deuterons, by electrostatic voltage excitation, follows directly from Eq. (3) with an appropriate Gamow factor $e^{-G}$. Experimental verification at ambient temperatures has been achieved. A few drops of water inside a Van de Graaff terminal were excited by voltages of about 1000 V. Substantial activity above background was observed by a Geiger Muller counter several feet away from the generator.

S. Experimental verification of the D-D fusion is planned in other ways.

(1) The detection of neutrons which are produced in the neutron branch of the primary D-D fusion. This will be done with a $BF_3$ counter or a silver foil.

(2) Capture and detection of $_2He^4$ produced in the fusion process.

(3) Measurement of the heat generated in the fusion process.

T. Decay is accelerated by electrostatic voltage excitation. Fusion is induced by the same process. It follows that alpha decay may be induced, given sufficient excitation energies. With voltages of the order of $10^6$ V, the production of rhodium, platinum, gold and $Hg^{196}$ can be achieved.

U. Experimental verification of the production of valuable isotopes has not been done. A feasibility experiment of this type is being planned using a Pelletron in the MV range. The synthesis will probably be rhodium from silver, as this is the most straightforward.

V. For the sake of safety, experimental work using electrostatic voltage excitation should be initiated with small samples.

W. The basic concept of electrostatic voltage excitation, described by F. and G. in this summary is simple. The implications of this concept, for the four areas of nuclear chemistry discussed in this patent application, are not at all obvious. The electrostatic generator, invented by Van de Graaff in 1931 has a number of applications in nuclear physics, but none of these involve electrostatic voltage excitation. The accelerated decay experiments described in Appendices B and C were performed to test the validity of the theory which was developed several years earlier. Both the theory and related experiments are new.

APPENDIX A

Nuclear Decay, Relative Stability, and Fission

(Prior Art)

I. Decay of Alpha, Beta and Gamma Sources

I-A. Natural Radioactive Decay: This is a well known phenomenon dating back to the 1890's when alpha, beta and gamma emitters were first discovered. The basic decay equation $$dN/dt = -N/\tau \quad \text{(A-1)}$$

holds for these types of decay. Here N (t) is the number of radioactive atoms at any time t, $\tau$ is the lifetime and dN/dt is the number of disintegrations per second. When the environment of the nuclear system is undisturbed, the decay time $\tau$ is constant and independent of time. Then it is easy to integrate Eq. (A-1) to obtain $$N = N_o e^{-t/\tau}. \quad \text{(A-2)}$$

This equation defines two other constants used in the literature of natural decay. The decay rate $\lambda = 1/\tau$ and the half-life $T_{\frac{1}{2}}$. The most familiar concept is half-life, defined as that value of t for which $N = N_o/2$. From Eq. (A-2), $$T_{\frac{1}{2}} = \tau \ln 2. \quad \text{(A-3)}$$

The half-life is 69.3% of the lifetime. The third constant is the decay rate $\lambda$ defined as $$\lambda = 1/\tau \quad \text{(A-4)}$$

An example may be used with $U^{238}$ where $T_{\frac{1}{2}} = 4.51 \times 10^9$y, $\tau = 6.51 \times 10^9$y and $\lambda = 4.87 \times 10^{-18} sec^{-1}$. Each of these numbers of course makes the same physical statement about the decay of $U^{238}$.

The half-life of a few thousand isotopes have been measured and are tabulated in the literature.[A-1]

[A-1] The primary reference used in this patent application for half-life and other relevant data is the *Handbook of Chemistry and Physics*, 68th Edition, Chemical Rubber Co. Press, Cleveland Ohio, pp. B-221-B-442.

Examples of several radioactive nuclides which occur as products of fission and breeder reactors are given in Table A-1.

TABLE A-1

Some products of fission and breeder reactors

| Nuclide | $T_{\frac{1}{2}}$ | Decay Mode | Decay Energy (MeV) | Activity (curies/gm) |
|---|---|---|---|---|
| $Pu^{239}$ | 24,400y | $\alpha$ | 5.592 | $6.13 \times 10^{-2}$ |
| $AM^{241}$ | 458y | $\alpha$ | 5.640 | 3.24 |
| $Sr^{90}$ | 28.1y | $\beta$- | 0.546 | $1.41 \times 10^2$ |
| $Cs^{137}$ | 30.23y | $\beta$- | 1.176 | 86.4 |
| $Co^{58}m$ | 9h | $\gamma$ | 0.025 | $6.6 \times 10^6$ |
| $Co^{60}m$ | 10.5m | $\gamma$ | 0.0586 | $2.98 \times 10^8$ |

The first three columns in Table A-1 are taken from the *Handbook of Physics and Chemistry*. The fourth column gives the activity in curies/gm for each nuclide where 1 curie $= 3.70 \times 10^{10}$ disintegrations per second. This is calculated from Eq. (A-1) as follows.

$$dN/dt = NA \ ln \ 2/(MT_{\frac{1}{2}} 3.70 \times 10^{10}). \quad \text{(A-5)}$$

In Eq. (A-5), $N_A$ = Avogadro's number $= 6.02 \times 10^{23}$, M = atomic mass in grams, and $T_{\frac{1}{2}}$ = half-life in seconds.

In one half-life, the mass of each nuclide decreases to one half of its initial value, and there is a corresponding reduction in activity. One gram of $Sr^{90}$ decays to 0.5 grams in 25.1 years by the reaction $$_{28}Sr^{90} \rightarrow {}_{39}Y^{90} + \beta^- + \upsilon \quad \text{(A-6)}$$

Yttrium 90, in turn, decays by $\beta^-$ emission to $_{40}Zr^{90}$ with a half-life of 64 hours. In just over 14 years, the activity of one gm of Strontium 90 is reduced to 71 curies, (abbreviated as Ci).

I-B. Natural Alpha Decay: One or more alpha particles exist as independent entities in all nuclides except hydrogen. This particle is a stable structure consisting of two protons and two neutrons. It carries a positive charge of 2e. There are more than 150 nuclei which decay spontaneously by alpha emission. Most of these have an atomic number $Z \geqq 60$. Examples are given in Table A-2.

TABLE A-2

| Several Alpha Emitters | | | |
|---|---|---|---|
| Nuclide | $T_{\frac{1}{2}}$ | E (MeV) | Atomic number of daughter |
| $_{85}At^{212}$ | 0.30s | 7.899 | 83 |
| $_{100}Fm^{254}$ | 3.24h | 7.31 | 98 |
| $_{84}Po^{210}$ | 138.4d | 5.408 | 82 |
| $_{90}Th^{228}$ | 1.913y | 5.521 | 88 |
| $_{88}Ra^{226}$ | 1600y | 4.781 | 86 |
| $_{92}U^{235}$ | $7.1 \times 10^8$y | 4.681 | 90 |
| $_{78}Pt^{190}$ | $6.0 \times 10^{11}$y | 3.18 | 76 |
| $_{60}Nd^{144}$ | $5 \times 10^{15}$y | 1.8 | 58 |

In the model which describes a spontaneous alpha emitter, an alpha particle oscillates inside a nuclear well whose radius is the nuclear radius, R. This particle is temporarily trapped in the well because its energy, E is less than the Coulomb barrier energy $2Ze^2/r$ of the daughter nucleus. Since the barrier has a finite thickness, the alpha particle has a non-zero probability of tunneling through the barrier. Coulomb barrier penetration is predicted by quantum mechanics, but this effect is not unique to quantum mechanics. In fact, evanescence, which occurs in total internal reflection is a form of barrier penetration. This is correctly explained by classical electromagnetic theory. In Table A-2, the experimental values for $T_{\frac{1}{2}}$ have a range of 24 orders of magnitude, but the corresponding measured values of E and Z differ by less than one order of magnitude. This suggests that a correct theory of alpha decay will show that $\tau_o$ depends exponentially on E and Z. The details leading to a successful theoretical expression for (E,Z) are given in the literature.[A-2]

[A-2] Stephen Gasiorwicz, *Quantum Physics*, John Wiley and Sons, Inc., New York, pp. 86–92.

The result is $$\ln \tau_o = 3.71Z/E^{\frac{1}{2}} - 3.69Z^{\frac{2}{3}} - 66.6 \quad \text{(A-7)}$$

Figure 5:
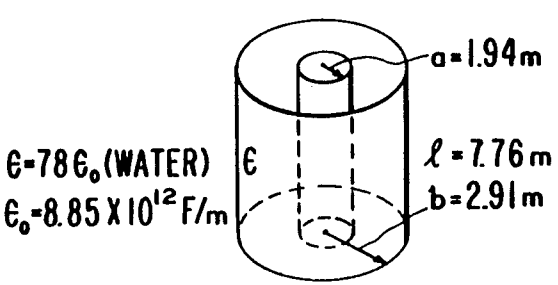
FIG. 5 is a schematic view of the electrostatic generator used in the deuteron-deuteron fusion process.

Let us see how well this works for $Ra^{226}$. Insert E=4.784 MeV and Z=86 from Table A-2 into Eq. (A-7). Then the theoretical value for $T_{\frac{1}{2}}=1107$y which agrees reasonably well with the experimental value of 1600y. In the case of $U^{238}$, the experimental value for $T_{\frac{1}{2}}=4.51\times10^9$y. Using Eq. (A-7) with E=4.194 MeV and Z=90, the theoretical value for $T_{\frac{1}{2}}=3.48\times10^9$y, which is low about 23%. The corresponding logarithmic values differ by just a few percent. In any event, Eq. (A-7) provides a good fit for the natural lifetime data of a large number of alpha emitters, as shown in FIG. 5.13 of Reference A-1*a*.

Reference A-1*a* E. K. Hyde, I. Perlman and G. T. Seaborg, *The Nuclear Properties of the Heavy Elements*, Volume I, Prentice Hall Inc., (1964). See reference A-2, p. 92.

TABLE A-2a

| Decay of $Am^{231}$ | | | | | |
|---|---|---|---|---|---|
| γ mode | γ (keV) | γ (%) | Count of maximum Unexcited source | Count at maximum Excited source | $I_e/I_o$ |
| Nplι | 11.87 | 0.81 | 144 | 783 | 5.44 |
| NpLα | 13.927 | 13.0 | $2.23 \times 10^3$ | $1.50 \times 10^4$ | 6.38 |
| NpLη | 15.561 | 0.33 | 267 | 766 | 2.87 |
| NpLβ1 | 16.890 | 4.25 | $2.37 \times 10^3$ | $6.58 \times 10^3$ | 2.78 |
| NpLβ2 | 17.611 | 15.95 | $9.49 \times 10^3$ | $1.85 \times 10^4$ | 1.95 |
| Nplγ1 | 20.997 | 5.2 | $3.61 \times 10^3$ | $5.17 \times 10^3$ | 1.43 |
| NpLγ2 | 21.11 | 1.82 | $2.45 \times 10^3$ | $3.27 \times 10^3$ | 1.33 |
| γE1 | 26.3445 | 2.4 | $4.20 \times 10^3$ | $3.27 \times 10^3$ | 0.78 |
| PaLα | 13.274 | (19.2) | Background | 766 | 6.06 |
| PalβI | 16.634 | (25) | overlaps NpLβ2 | 1800 | 4.08 |
| γE1 | 29.378 | (12.9) | too close to background | too close to background | |

I-C. Natural Beta Decay: Empirically, there are three kinds of beta decay: (1) Electron or beta minus decay, e.g. $_6C^{14} \rightarrow {}_7N^{14} + \beta^- + \nu e$; (2) Positron or beta plus decay, e.g. $_5B^8 \rightarrow {}_4Be^7 + \beta^+ + \nu e$; (3) Electron capture, e.g. $_4Be^7 + e^- \rightarrow {}_3Li^7 + \nu e$. In the case of $\beta^-$ emission, as in $C^{14}$, a neutron inside the nucleus is transformed into a proton $$n \rightarrow p + e^- + \nu e \; (e^- = \beta^-) \quad \text{(A-8)}$$

The third particle on the right is an anti-neutrino. This process conserves energy, charge, momentum, angular momentum and lepton (light particle) number. In a given decay, the particle energy may be less than the decay energy. The difference is carried off by the anti-neutrino.

In the case of $\beta^+$ emission, as in Boron 8, a proton inside the nucleus is transformed into a neutron $$p \rightarrow n + e^+ + \nu e \; (e^+ = \beta^+) \quad \text{(A-9)}$$

The third particle on the right is a neutrino. This process also conserves energy, charge, momentum, angular momentum and lepton (light particle) number. In the case of electron capture (E.C.), as in Beryllium 7, a proton in the nucleus captures an electron from the innermost shell of the atom, transforming it into a neutron.

$$p + e^- \rightarrow n + \nu e. \quad \text{(A-10)}$$

All possible nuclear beta processes are described by the symmetrical relation $$p + e^- \rightleftharpoons n + \nu e. \quad \text{(A-11)}$$

If the neutrino or the electron symbol is moved from the left to the right side of this reaction, it must be written as the corresponding anti-particle to conserve lepton number. Thus, Eq. (A-10) is identical with Eq. (A-9). Move $e^-$ in Eq. (A-10) to the right side to obtain Eq. (A-9), or move $\nu e$ to the left side to obtain Eq. (A-8).

Unlike the alpha particle, the electron or positron emitted from a nucleus does not have an independent existence inside the nucleus. Actually, the nucleus does not have room for the electron. This is easy to see if we take Carbon 14 as an example. The radius of the nucleus $$R=1.5\times10^{-13}A^{\frac{1}{3}}\text{ cm}=3.62\times10^{-13}\text{ cm},\qquad\text{(A-12)}$$

where A = 14 is the number of nucleons in Carbon 14. In $C^{14}$ decay, the energy is 0.156 MeV. The spatial extent of the $\beta^-$ is measured by its de Broglie wave length, which may be calculated from $$\lambda=h/p=h/(2mE)^{\frac{1}{2}}=3.11\times10^{-12}\text{ cm}.\qquad\text{(A-13)}$$

Evidently, $\lambda/R=8.6$, which means the electron must come into existence the moment it is ejected from the nucleus by the decaying neutron.

In the theory of beta decay, however intricate the process, the natural decay rate always depends on the value of the electron density at the nucleus: $\psi^*\psi(0)$. This factor occurs repeatedly in Konopinski's[A-3] book in the form of $F(E,Z)=|\psi e\ (0)|^2/|\psi_o\ (0)|^2$ where $|\psi e|^2$ is the spatial density of the electron in the field of the nuclear charge and $|\psi_o|^2$ is the "free particle" density in the absence of the electrostatic force.

[A-3] E. J. Konopinski, *The Theory of Beta Radioactivity*, Oxford, Clarendon Press, 1966, p. 10, 131, 133, 266, 207, 257.

Notice that F (E,Z) depends on the same two parameters in beta decay as does the lifetime $\tau$ in alpha decay. In beta decay there is no Coulomb barrier for the electron, but there is for the positron. In fact, the expression for F (E,Z) is smaller for positrons than for electrons by the Coulomb barrier factor $G=\exp(-2\pi Ze^2/hv)$. This same probability factor appears in the theory of alpha decay. Both the positrons and the alpha particles are confronted by a positive potential Ze/r due to the daughter nucleus. $_{71}Lu^{170}$ is a typical example of a nuclide whose $\beta+$ decay is delayed by this barrier.

$$_{71}Lu^{170}\rightarrow{}_{70}Y^{170}+\beta^++\upsilon e+3.41\text{ MeV, with } T_{\frac{1}{2}}=2d.\qquad\text{(A-14)}$$

The positron carries off 3.41 MeV at the relativistic speed v=0.991 c. In this case G=0.039. Without the barrier, $Lu^{170}$ would have decayed in 0.078 days which is about 2.6 times faster.

The general features of natural beta decay are understood. But unlike natural alpha decay, there are no simple formulas which give results for the lifetime in agreement with observation. However, there is extensive numerical data. A number of examples are given in Table A-3 for $\beta^-$ decay and in Table A-4 for $\beta^+$ decay and electron capture. The latter two frequently occur together.

TABLE A-3

Examples of $\beta^-$ – decay

| Nuclide | $T_{\frac{1}{2}}$ | Decay Mode | Decay Energy (MeV) | Particle Energy (MeV) |
|---|---|---|---|---|
| $_{27}Co^{63}$ | 52s | $\beta^-$ | 3.6 | 3.6 |
| $_{25}Mn^{56}$ | 2.576h | $\beta^-$ | 3.702 | 2.84 47%<br>1.03 34%<br>0.72 18%<br>0.30 1% |
| $_{18}Ar^{42}$ | 33y | $\beta^-$ | 0.60 | 0.60 |
| $_{6}C^{14}$ | 5730y | $\beta^-$ | 0.156 | 0.156 |
| $_{4}Be^{10}$ | $2.5\times10^6$y | $\beta^-$ | 0.55 | 0.55 |
| $_{19}K^{40}$ | $1.28\times10^9$y | $\beta^-$, $\beta^+$, EC | 0.135<br>1.505 | 1.35%<br>0.49% |

TABLE A-4

Examples of $\beta^+$ decay and electrol capture

| Nuclide | $T_{\frac{1}{2}}$ | Decay Mode | Decay Energy (MeV) | Particle Energy (MeV) |
|---|---|---|---|---|
| $_{5}B^{8}$ | 20.77s | $\beta^+$ | 18 | 13.7 |
| $_{33}As^{69}$ | 15m | $\beta^+$, EC | 3.9 | 2.9 |
| $_{31}Ga^{66}$ | 9.4h | $\beta^+$, EC | 5.175 | .74 1%<br>0.84 54%<br>4.153 51% |
| $_{38}Sr^{85}$ | 64d | EC | 1.11 | |
| $_{26}Fe^{55}$ | 2.6y | EC | 0.232 | |
| $_{42}Mo^{93}$ | > 100y | EC | | |
| $_{57}La^{137}$ | $6\times10^4$y | 0.5 | | |
| $_{13}Al^{26}$ | $7.4\times10^5$y | $\beta^+$, EC | 4.003 | 1.16 |
| $_{52}Te^{163}$ | $1.2\times10^{13}$y | $\beta^+$, EC | 0.06 | |

In Tables A-3 and A-4, the experimental values of $T_{\frac{1}{2}}$ have a range of 19 orders of magnitude, while the corresponding energy range extends over only two orders of magnitude. In this sense, beta decay is similar to alpha decay.

The decay of $Mn^{56}$ illustrates the point that the decay energy is not necessarily the particle energy. The decay energy is the maximum a beta minus carries off in the process. The particle energy is 3.702 MeV. The beta minus spectrum exhibits four maxima at 2.84, 1.03, 0.72, and 0.30 MeV in the ratio of 0.47, 0.34, 0.18, and 0.01 respectively. The balance of the energy made available in the decay is carried off by anti-neutrinos.

I-D. Natural Gamma Decay: If a nucleus undergoes a transition from a state of higher energy to a state of lower energy without emitting a nucleon or changing its charge, the decay is by gamma ray emission or by internal conversion. Gamma ray emission occurs when an excited nucleus interacts with an electromagnetic radiation field which is external to the atom. Internal conversion occurs when an excited nucleus gives up its energy to an atomic electron. The electron is ejected from the atom with an energy equal to the energy lost by the nucleus, minus the binding energy of the electron. Internal conversion in nuclear systems is similar to the Auger effect in atomic systems.

Isomers are nuclei which undergo gamma ray transitions with readily observed half-lives in the order of seconds, days or years. Examples of isomeric transitions are given in Table A-5. A few gamma ray transitions whose lifetimes are $\sim10^{-7}$ seconds or less are also given.

TABLE A-5

Several observed isomeric transitions[A-4]

| Nuclide | $T_{\frac{1}{2}}$ | Decay Mode | E (KeV) |
|---|---|---|---|
| $_{63}Eu^{151m2}$ | — | | 18.3, 39.7, 88.8 |
| $_{86}Rn^{211}$ | — | ,α | 68.7, 169, 232 |
| $_{63}Eu^{151m}$ | 58s | I.T. | |
| $_{21}Sc^{50}$ | 0.35s | I.T. | 258 |
| $_{27}Co^{58m}$ | 9.0h | I.T. | 25 |
| $_{43}Tc^{97m}$ | 90d | I.T. | 96.5 |
| $_{72}Hf^{178m2}$ | 10y | I.T. | 2500 |

[A-4] Handbook of Chemistry and Physics, 57th Edition, CRC Press, Cleveland, Ohio. The isomeric transitions, (I.T.) are given in the Table of Isotopes pp. B271–B354. The gamma transitions with very short or unknown half-lives are taken from the same handbook, pp. B355–B427.

The total number of gamma decays which have been measured exceeds 10,000. A gamma ray is an electromagnetic wave, which differs from an optical or radio wave only in wave length. All electromagnetic waves involve oscillating electric and magnetic fields, generated by oscillating electric charges or currents. Electric multipole radiation, designated E-l, is produced by an oscillating electric charge. Magnetic multipole radiation, designated M-l, is produced by an oscillating electric current. The symbol "l" is an integer denoting a term in a multipole expansion. For example, electric dipole radiation is designated E-2 and magnetic quadropole radiation is designated M-3.

In the literature,[A-5,A-6,A-7] there are formulas of increasing sophistication which describe the mean life, $\tau$ or the decay rate $\lambda$ for electric and magnetic multipole radiation.

[A-5] Robert S. Shankland, *Atomic and Nuclear Physics*, The MacMillan Co., New York, 1955. p. 353, Eq. (28).

[A-6] Bernard L. Cohen, *Concepts of Nuclear Physics*, McGraw Hill Book Co., New York, 1971. Chapter 12, Eqs. (12-3, 12-6, and 12-9). Figures 12-1 and 12-2.

[A-7] E. U. Condon and Hugh Odishaw, *Handbook of Physics*, McGraw Hill Book Co., 1967. Chapter 6, Eqs. (6-16) and (6-17).

For the purpose of this patent application, Shankland's formula is sufficient $$\tau = \frac{3.9 \times 10^{-21}(\Delta I)!^2(137mc^2/E)^2(\Delta I + 1)}{R^2(\Delta I)} \quad \text{(A-15)}$$

Here, $\Delta Ih/2\pi$ is the change in nuclear angular momentum during the transition, $mc^2$ is the electron rest energy=0.511 MeV, E is the energy of the gamma transition on MeV, and R is the nuclear radius in units of $e^2/mc^2$. That is, $R=0.5A^{166}$ . Using Eq. (A-14) and Table A-6, four decay constants are calculated and compared with the measured values.

TABLE A-6

A few theoretical and observed isomeric decay constants

| Nuclide | $\log_{10}$ (theoretical) | $\log_{10}$ (expt) | $\Delta I$ |
|---|---|---|---|
| $_{21}Sc^{50m}$ | 0.974 | 0.297 | 3 |
| $_{27}Co^{58m}$ | −7.01 | −4.67 | 3 |
| $_{43}Tc^{97m}$ | −8.10 | −7.05 | 4 |
| $_{78}Hf^{178m2}$ | −11.1 | −7.49 | 5 |

The order of the transition is determined by $\Delta I$. Thus $\Delta I=1$ is either electric dipole (E-2) or magnetic dipole (M-2), $\Delta I=2$ refers to dipole radiation, $\Delta I=3$ to quadropole radiation, etc. The higher the multiplicity, the longer the lifetime. Angular correlation experiments are used to determine multiplicity, and polarization experiments are used to distinguish electric from magnetic dipole radiation.

II. Nuclear Stability

The stability of a nuclide is relative. The degree of stability can be made quantitative using the principle of the conservation of energy with nuclide mass data. Mass spectrometry[A-8] data has an accuracy of one part in $10^7$.

[A-8] Reference A-5, Chapter 7. p. 170; reference A-6, p. 161, and reference A-1, pp. B221–B442.

The stability of a nucleus is given by the binding energy per nucleon, B/A. If a nucleus of mass M contains A protons and N neutrons, its binding energy is $$B(Z,N)=(ZMp+NMn-M)c^2. \quad \text{(A-16)}$$

where Mp=1.008986 amu, Mn=1.008986 amu, M=nuclide mass from the measured data in amu. The atomic mass unit (amu)=931.5016 MeV/$c^2$. This equation is used to calculate B/A for seven typical nuclides. The mass number A=Z+N.

TABLE A-7

The binding energy per nucleon for several nuclides

| Nuclide | Mass(amu) | Z | N | B | B/A | Natural Abundance |
|---|---|---|---|---|---|---|
| $_1H^2$ | 2.0147425 | 1 | 1 | 2.23 | 1.12 | 0.015% |
| $_2He^4$ | 4.004874 | 2 | 2 | 28.31 | 7.08 | 100% |
| $_{26}Fe^{56}$ | 55.952725 | 26 | 30 | 492.41 | 8.79 | 91.66% |
| $_{45}Rh^{103}$ | 102.93727 | 45 | 58 | 885.33 | 8.59 | 100% |
| $_{47}Ag^{107}$ | 106.93882 | 47 | 60 | 915.7988 | 8.56 | 51.82% |
| $_{48}Po^{210}$ | 209.9829 | 84 | 126 | 1707.868 | 8.13 | 100% |
| $_{92}Y^{239}$ | 238.1243 | 92 | 146 | 1795 | 7.54 | 99.3% |

Table A-7 illustrates the fact that nuclear stability, as gauged by B/A, is a maximum for $_{26}Fe^{56}$. This value is less for more massive and for less massive nuclides.

We note for future reference, (Section IV), that the binding energy per nucleon is greater for rhodium than it is for silver.

III. The Energetics of Spontaneous and Induced Alpha and Beta Decay

A nuclear transmutation occurs spontaneously if the mass of the parent nuclide is greater than the mass of the decay products. In this case, the energy release is Q>0, and the reaction is exothermic. However, if Q<0, the reaction is endothermic. It may be induced to occur if an excitation energy greater than |Q| is supplied. In alpha decay, the parent p decays into a daughter d and an alpha particle, releasing energy Q. The decay energy Q may be calculated from mass data $$Q=(M_p-M_d-M_\alpha)c^2 \quad \text{(A-17)}$$

where M=4.00260 amu. The maximum alpha particle energy $(E_\alpha)$max is slightly less than the disintegration energy Q because of the recoil of the daughter nucleus. That is $$(E\alpha)\max = \frac{Q}{1 + M/Md} \quad \text{(A-18)}$$

Frequently alpha particles carry off an energy $E<(E_\alpha)$-max. This means that the decay has not gone to the ground state, but to an excited state, which subsequently decays by gamma emission to the ground state.

Table A-8 gives calculated and observed Q and E values for several cases of spontaneous and induced alpha decay. The reactions considered are:

$$_{92}U^{238} \rightarrow {}_{90}Th^{234} + \alpha$$

$$_{90}Th^{230} \rightarrow {}_{88}Ra^{226} + \alpha$$

$$_{84}Po^{210} \rightarrow {}_{82}Pb^{206} + \alpha$$

$$_{80}Hg^{198} \rightarrow {}_{78}Pt^{194} + \alpha$$
(10.1%) (32.9%)

$$_{80}Hg^{198} \rightarrow {}_{75}Pt^{195} + \alpha$$
(17%) (33.8%)

$$_{80}Hg^{200} \rightarrow {}_{78}Pt^{196} + \alpha$$
(23.1%) (25.3%)

$$_{80}Hg^{202} \rightarrow {}_{78}Pt^{198} + \alpha$$
(29.65%) (7.2%)

-continued $$_{47}Ag^{107} \rightarrow {}_{45}Rh^{103} + \alpha$$
(51.84%) (100%)

TABLE A-8

| Nuclide | Mp | Md | Q(calc) | Q(obs) | E(calc) | E(obs) | % |
|---|---|---|---|---|---|---|---|
| | Calculated and observed Q and E values for several cases of alpha decay | | | | | | |
| $_{92}U^{235}$ | 238.050784 | 234.043593 | 4.274 | 4.268 | 4.202 | 4.196 | 77 |
| | | | | | | 4.175 | 23 |
| | | | | | | 4.039 | 0.23 |
| $_{90}U^{230}$ | 230.033127 | 226.025402 | 4.774 | 4.771 | 4.691 | 4.688 | 76.3 |
| | | | | | | 4.621 | 23.4 |
| | | | | | | 4.480 | 0.12 |
| | | | | | | 4.438 | 0.03 |
| $_{84}Po^{210}$ | 209.982848 | 205.97440 | 5.410 | 5.407 | 5.306 | 5.304 | 100 |

There is excellent agreement between the calculated and observed Q and E values in these three cases. This means that the theory can be relied on to make accurate predictions for the Hg→Pt and the Ag→Rh alpha transmutations. This is one of the major applications presented in this patent application, for the electrostatic voltage excitation process which will be discussed in Section IV.

TABLE A-9

| Nuclide | $M_p$ | $M_d$ | Q(calc) | E(calc) |
|---|---|---|---|---|
| $_{80}Hg^{198}$ | 197.966743 | 193.96255 | .484 | 1.453 |
| $_{80}Hg^{199}$ | 198.968254 | 194.964766 | 0.827 | 0.810 |
| $_{80}Hg^{200}$ | 199.968300 | 195.964926 | 0.721 | 0.707 |
| $_{80}Hg^{202}$ | 201.970617 | 197.967869 | 0.138 | 0.135 |
| $_{47}Ag^{107}$ | 106.905092 | 102.905500 | −2.802 | |

The four Hg→Pt decays are exothermic, but with extremely long half-lives because the disintegration energy is so low. The Ag→Rh transformation is endothermic. The half-life for the $_{80}Hg^{198} \rightarrow {}_{78}Pt^{194} + \alpha$ decay may be calculated from Eq. (A-7), and the result is $T_{\frac{1}{2}} = 6.37 \times 10^{39}$ years. The other three Hg→Pt half-lives are even longer because the Q values are smaller. Natural decay is not observed. But voltages in the MW range do induce alpha decay, as will be discussed in Section IV.

The energetics of beta decay is well understood and is explained in the literature.[A-9]

[A-9] Reference A-7, pp. 9–55, and reference A-3, p.2.

The free neutron decays spontaneously with a half-life of twelve minutes.

$$n \rightarrow p + e^- + \nu \qquad \text{(A-19)}$$

$$(m_n - m_p)c^2 = (1.08665 - 1.007825)\ (\text{amu})c^2 = 0.7824\ \text{MeV}$$

This is the decay energy. The free proton does not decay spontaneously because it is less massive than a neutron. However, the reaction $$p \rightarrow n + e^+ + \nu \qquad \text{(A-20)}$$

does occur if an additional energy $W_i = (0.7824 + 0.511)$ MeV = 1.2935 MeV is provided. In Table A-10, data on several beta interactions are given.

TABLE A-10

| Beta Process | $T_{\frac{1}{2}}$ | Mp(amu) | Md(amu) | Q (MeV) | Beta Energy (MeV) | μ Energy (MeV) |
|---|---|---|---|---|---|---|
| | The energetics in several beta decay processes | | | | | |
| $_{38}Sr^{90}\ \overrightarrow{\beta}-\ {}_{39}Y^{90}$ | 29y | 89.907738 | 89.907152 | 0.546 | 0.546 | 0 |
| $_{4}Be^{10}\ \overrightarrow{\beta}-\ {}_{5}B^{10}$ | $1.6 \times 10^6$y | 10.013534 | 10.012937 | 0.556 | 0.556 | 0 |
| $_{55}Cs^{137}\ \overrightarrow{\beta}-\ {}_{56}Ba^{137}$ | 30.17y | 136.907073 | 136.905812 | 1.17 | 0.514 | 0.656 |
| $_{10}Ne^{19}\ \overrightarrow{\beta}-\ {}_{9}F^{19}$ | 17.22 | 19.001879 | 18.998403 | 3.238 | 2.22 | 0 |
| $_{22}Ti^{45}\ \overrightarrow{\beta}+\ {}_{21}Sc^{45}$ | 3.078h | 44.958124 | 44.955910 | 2.062 | 1.004 | 0 |
| $_{80}Hg^{197} + e^- \rightarrow {}_{79}Au^{197}$ | 64h | 196.967187 | 196.966543 | 0.600 | — | 0 |

In Table A-10, the experimental atomic mass values are used to calculate the decay energy. This is given in each case by $$Q = (Mp - Md)c^2. \qquad \text{(A-21)}$$

These calculated values agree with the accepted tabulated values to at least three significant figures. The $\beta^-$ energy is the same as the decay energy, unless some is carried off by a neutrino or anti-neutrino. The first three examples are $\beta^-$. The maximum $\beta^+$ energy is always less than the decay energy by $2m_0c^2 = 1.022$ MeV, as illustrated by examples four and five in Table A-10. The last example illustrates the electron capture process in which a proton is converted into a neutron following the capture of an electron near the nucleus.

IV. Fission

The word fission refers to the act of splitting an atom into approximately equal parts. The most common usage is in connection with the fission of $_{92}U^{235}$ and $_{94}Pu^{239}$, which are used in nuclear burner and breeder reactors. In a broad sense the word fission also applies to the disintegration of the deuteron by a gamma ray $$\gamma + 1^{D2} \rightarrow 1^{H1} + o^{n1}. \qquad \text{(A-22)}$$

The threshold energy required for this process is the binding energy of the deuteron, which is 2.23 MeV. (See Table A-7). There are a number of cases of spontaneous fission in which an atom splits without external excitation. For example, $_{105}Ha^{262}$ with $T_{\frac{1}{2}} = 34$s; $_{102}No^{258}$ with $T_{\frac{1}{2}} = 1.2$ ms; 100 $Fm^{244}$ with $T_{\frac{1}{2}} = 3.7$ ms, and $_{98}Cf^{254}$ with $T_{\frac{1}{2}} = 60.5$ d. The spontaneous fission of $U^{238}$ does occur, but with a half-life of about $5\times10^{15}$ years.

The excitation to induce fission of $_{92}U^{235}$ and $_{94}Pu^{239}$ is provided by a thermal neutron. The $U^{235}$ fission reaction, discovered by Otto Hahn and Fritz Strassman in 1938 produced barium and krypton with atomic numbers of 56 and 36 respectively. In the past fifty years more than thirty ways have been found in which $U^{235}$ fissions. A typical reaction is $$_0n^1+_{92}U^{235}\rightarrow_{54}Xe^{140}+_{38}Sr^{94}+2_0n^1. \quad \text{(A-23)}$$

The energy release can be calculated from the measured masses. Thus $$Q=(235.043924-139.915367-1.008665)\ (\text{amu})c^2=185\ \text{MeV} \quad \text{(A-24)}$$

This is about 15 MeV less than the Q which occurs in other fission reactions. A chain reaction is assured by the presence of two or more neutrons among the fission fragments. The Xe and Sr fission products are both beta emitters. $U^{235}$ is relatively scarce. It is possible to produce fissile material from two other more abundant sources; $U^{238}$ and $Th^{232}$.

$$_0n^1+U^{238}\rightarrow Pu^{239}$$

$$_0n^1+Th^{232}\rightarrow U^{233} \quad \text{(A-25)}$$

Fission burner and breeder reactors generate ~1000 MW of power, and each reactor produces about one metric ton of radioactive waste material per year. The principal waste products[A-10] are given in Table A-11.

[A-10] Energy and Ecology; University of Michigan, Sinauer Associates, (1985), Chapter 13. *Nuclear Power*, Dr. David M. Gates.

TABLE A-11

Radioactive waste products from nuclear fission reactors

| Nuclide | Decay Mode | Half-life | Activity (curies/gm) |
|---|---|---|---|
| $_{95}Am^{241}$ | $\alpha$ | 432.2 y | 3.43 |
| $_{95}Am^{243}$ | $\alpha$ | $7.37\times10^3$ y | 0.19 |
| $_6C^{14}$ | $\beta^-$ | 5730 y | 5.15 |
| $_{55}Cs^{134}$ | $\beta^-$ | 2.06 y | $1.30\times10^3$ |
| $_{55}Cs^{137}$ | $\beta^-$ | 30.17 y | 86.5 |
| $_{27}Co^{58}$ | $\beta^+$, EC | 70.91 d | $3.17\times10^4$ |
| $_{27}Co^{60}$ | $\beta^-$ | 5.272 y | $1.13\times10^3$ |
| $_{53}I^{129}$ | $\beta^-$ | 1.67 y | $1.73\times10^{-4}$ |
| $_{53}I^{131}$ | $\beta^-$ | 8.04 d | $1.24\times10^5$ |
| $_{36}Kr^{95}$ | $\beta^-$ | 10.72 y | $3.92\times10^2$ |
| $_{92}Np^{237}$ | $\beta^-$ | $2.14\times10^6$ y | $7.06\times10^{-4}$ |
| $_{94}Puphu$ 240 | $\alpha$ | $2.411\times10^4$ | $6.21\times10^{-2}$ |
| $_{38}Sr^{90}$ | $\beta^-$ | 29 y | $1.37\times10^2$ |
| $_{43}Tc^{99}$ | $\beta^-$ | $2.13\times10^5$ y | $1.69\times10^{-2}$ |
| $_1H^3$ | $\beta^-$ | 12.26 y | $9.73\times10^3$ |
| $_{92}U^{235}$ | $\alpha$ | $7.08\times10^8$ y | $2.15\times10^{-6}$ |
| $_{92}U^{238}$ | $\alpha$ | $4.46\times10^9$ y | $3.37\times10^{-7}$ |
| $_{84}Xe^{133}$ | $\beta^-$ | 5.25 d | $1.87\times10^5$ |
| $_{84}Xe^{135}$ | $\beta^-$ | 9.10 h | $2.55\times10^6$ |

In Table A-11, the main fission products are $Sr^{90}$, $Cs^{137}$ and $Kr^{85}$. These are $\beta^-$ emitters with half-lives ranging from ten to thirty years and activities ranging from 87 to 392 curies/gram. The most abundant waste is $U^{238}$, which does not fission. In breeder reactors some of the $U^{239}$ is converted into $Pu^{239}$, which is fissile.

The material presented in this appendix is background information which is useful for an understanding of the material presented in the main body of this patent disclosure.

APPENDIX B

Accelerated Thorium 230 Decay by Coulomb Barrier Modification

The theory of alpha decay is modified to include the effect of an applied electrostatic potential. If a radioactive nucleus is embedded in a conductor, the theory postulates that the applied voltage extends to the nuclear surface where it modifies the Coulomb barrier. The theory predicts that the decay constant depends exponentially on the voltage. Observations of $Th^{230}$ positioned inside the spherical terminal of a Van de Graaff generator, confirm the theory for both the negative and positive voltages ranging from 0 to 43 kV. The activity in counts/sec was increased by a factor of 4.14 at $\phi=-42.3$ kV.

Generally speaking, the scientific community believes that the decay rate $\lambda$ of a radioactive nucleus is immutable. However, it is possible to change $\lambda$ by changing the environment of the emitter. According to the theory of beta decay, $\lambda$ is proportional to $\rho(0)=e\psi^*\psi(0)$, the electron charge density at the nucleus. Consider the process of electron capture in $Be^7$. Suppose the Be atom were stripped completely of its four electrons. Then, $\rho(0)=0$ and the decay rate would change from $\lambda_0=1.50\times10^{-7}\ \text{sec}^{-1}$ to $\lambda=\infty$. If $\rho(0)$ is made to increase, the decay will exhibit a positive enhancement $\epsilon=\Delta\lambda/\lambda$. This concept is due to Segrè and Wiegand[B-1] who succeeded in showing that $\lambda$ in BeO is less than it is in Be. Subsequent experiments by Johlige, Aumann and Born[B-2] on seven different $Be^7$ compounds yielded positive and negative values of $\epsilon$.

[B-1] E. Segrè and C. E. Wiegand, Phys. Rev. 75, 39 (1949).
[B-2] H. W. Johlige, D. C. Aumann and H. J. Born, Phys. Rev. 2, 1616 (1970).

Nuclear isomeric transitions occur either by gamma emission or by an internal conversion electron. Therefore, the decay rate may be expected to vary with local changes in the electronic environment. Experimental work on $Tc^{99m}$ and $U^{235m}$ confirm this ideal. It was found that pressure[B-3] affects $\lambda$; normal and superconducting[B-4] $Tc^{99m}$ have different values of $\lambda$; and $U^{235m}$ implanted in different transition metals[B-5] exhibits distinguishable values of $\lambda$.

[B-3] R. A. Porter and W. G. McMillen, Phys. Rev. 117, 795 (1960).
[B-4] Don H. Byers and Robert Stump, Phys. Rev. 112, 77 (1958).
[B-5] M. Neve de Mevergnies, Phys. Rev. Lett. 29, 1188 (1972).

These experiments on beta and gamma decay demonstrate that any rearrangement of the electron charge distribution inside the atom may produce a measurable change in $\lambda$. In all the cases investigated, the effect is small where $\epsilon\sim0.1\%$. The present work concerns alpha decay enhancement, a process not studied by the investigations previously cited. The conventional theory of alpha decay is very well known.[B-6] The decay is described as the tunneling of an alpha particle through the Coulomb potential barrier of the daughter nucleus. The decay constant is determined by the energy E of the alpha particle and by the height and width of the barrier. The theory leads to a relationship between $\lambda$, E and the charge of the daughter nucleus $Z_1$, which fits the data extremely well.[B-7]

[B-6] G. Gamow, Zeit. f. Phys. 1, 204 (1928), E. O. Condon and P. W. Gurney, Nature 122, 439 (1928) and Phys. Rev. 33, 127 (1929). See also S. Gasiorowicz, *Quantum Physics*, Wiley, N.Y. (1974) p. 89ff.
[B-7] See E. K. Hyde, I. Perlman and G. T. Seaborg, *Nuclear Properties of the Heavy Elements*, Vol. I Prentice Hall (1964) and R. Taagepera and M. Nurmia, Ann Acad. Sci. Fenn. A78 VI I (1961).

The atomic electrons in an alpha emitter also influence the decay rate.[B-8] For example, in $Th^{230}$ these electrons generate a constant potential $\phi=-17.5$ kV which extends to the nuclear surface, decreasing the height and width of the Coulomb barrier. Although the corresponding potential energy is small compared to E, it has a nontrivial effect on the decay constant. In fact, if all of the atomic electrons were stripped off the thorium atom, the half-life would be increased from 75,400 to 146,000 years.

[B-8] J. Perlman and J. A. Rasmussen, Alpha Radioactivity, *Handbuch der Physik* 42, Springer Verlag, Berlin (1957).

The new feature in the modified theory of alpha decay which is introduced in this paper, is that $\lambda$ can be controlled by an applied electrostatic voltage $\phi$. This voltage is incorporated into the quantum mechanical tunneling equation for the transmission coefficient, T*T by including an additional potential energy $$V=-2|e\phi|, \tag{B-1}$$

where $2e$ is the charge of the alpha particle. Hence $$T^*T=\exp(-G) \tag{B-2}$$

where $$G = 2(2M/\lambda^2)^{\frac{1}{2}} \int_R^b dr(2Z_1e^2/r - E + V)^{\frac{1}{2}} \tag{B-3}$$

With V=0, this expression is well known.[B-9] Clearly V modifies the height and width of the Coulomb barrier. The turning point $$b=2Z_1e^2/(E-V) \tag{B-4}$$

is greater or less than $b_0=2Z_1e^2/E$ for V positive or negative. Assuming that b is large compared to the nuclear radius, it follows that $$\ln \lambda/\lambda_0=3.71Z_1(E^{-\frac{1}{2}}-(E-V)^{-\frac{1}{2}}). \tag{B-5}$$

where 3.71 is a fit parameter used by Taagepera and Nurmia.[B-10] It is clear that V controls $\lambda$. For negative (positive) applied voltages, the enhancement $$\epsilon=(\lambda-\lambda_0)/\lambda_0 \tag{B-6}$$

will be positive (negative). An appropriate form for Eq. (B-5) is useful when $|V|<<E$.

$$\ln \lambda/\lambda_0=-3.71Z_1e\phi/E^{3/2} \tag{B-7}$$

In the $Th^{230}$ measurements $|V|\leqq 90$ KeV$\sim 2E\times 10^{-2}$. For this isotope, theory predicts a linear relationship between $\ln \lambda/\lambda_0$ and $e\phi$ with a slope of $-31.37/\text{MeV}^{\frac{1}{2}}$.

[B-9] See Gasiorowicz, reference 6, p. 90.

[B-10] See reference B-7.

In the experimental work, we used a $Th^{230}$ source, with an activity of 0.1 $\mu$Cl. As Th0, this was electrodeposited and diffusion bonded on a backing of 0.001 inch platinum in a metal cylinder with a diameter of 24 mm and a thickness of 3 mm. This was made to specification by the Isotope Products Laboratories in Burbank, Calif.

Our detection equipment (FIG. 1) consisted of a Geiger-Muller Tube and Scaler provided by the Nucleus, Inc. of Oak Ridge. The GM tube, (Model PK2) detects alphas, betas and gammas. The Scaler, (Model 500) was equipped with an eight foot coaxial MHP connector to shield it from the effects of the high voltage generator.

The high voltage $\phi$ was provided by two 250,000 volt Van de Graaff generators of opposite polarity. These were obtained from the Wabash Instrument Co., (Model N100-V). The terminals of these generators are approximately spherical with a diameter of 25 cm. Inside the cavity of the high voltage terminal, the potential is homogeneous and the electric field is zero.

The source was housed in a metal clamp inside the Van de Graaff. The clamp was screwed into a wooden or plastic block mounted on the outside of the sphere. The GM tube was inserted to various depths into a 3.5 cm diameter hole in the block. The source was exposed to the sensor by a 15 mm hole at the top of the sphere.

When the Van de Graaff was turned on with the detection equipment in place, the highest voltage we could obtain was ~50 kV. We made crude measurements of the voltage from spark lengths estimating 30,000 volts per inch. A better measure is provided by the source to sensor distance. This gives reasonable voltage values if the belt speed is increased slowly to the point where there is an electron discharge and the counter goes off scale.

Under suitable physical conditions, this theory postulates that an external electrostatic voltage penetrates the interior of an atom to the nuclear surface. Better results are achieved if the source is in a metallic environment. The Van de Graaff generator is a simple and convenient high voltage source. On the spherical surface of radius a, the voltage is $\phi=Q/4\pi\epsilon_0 a$, where Q is the charge, negative or positive, delivered by the belt. This potential is constant inside the sphere where the field is zero. Outside the sphere $\phi\rightarrow 0$. Both the base of the Van de Graaff and the GM-Scaler detection system were grounded. It is this potential $\phi$ which modifies the Coulomb barrier.

Figure 7:
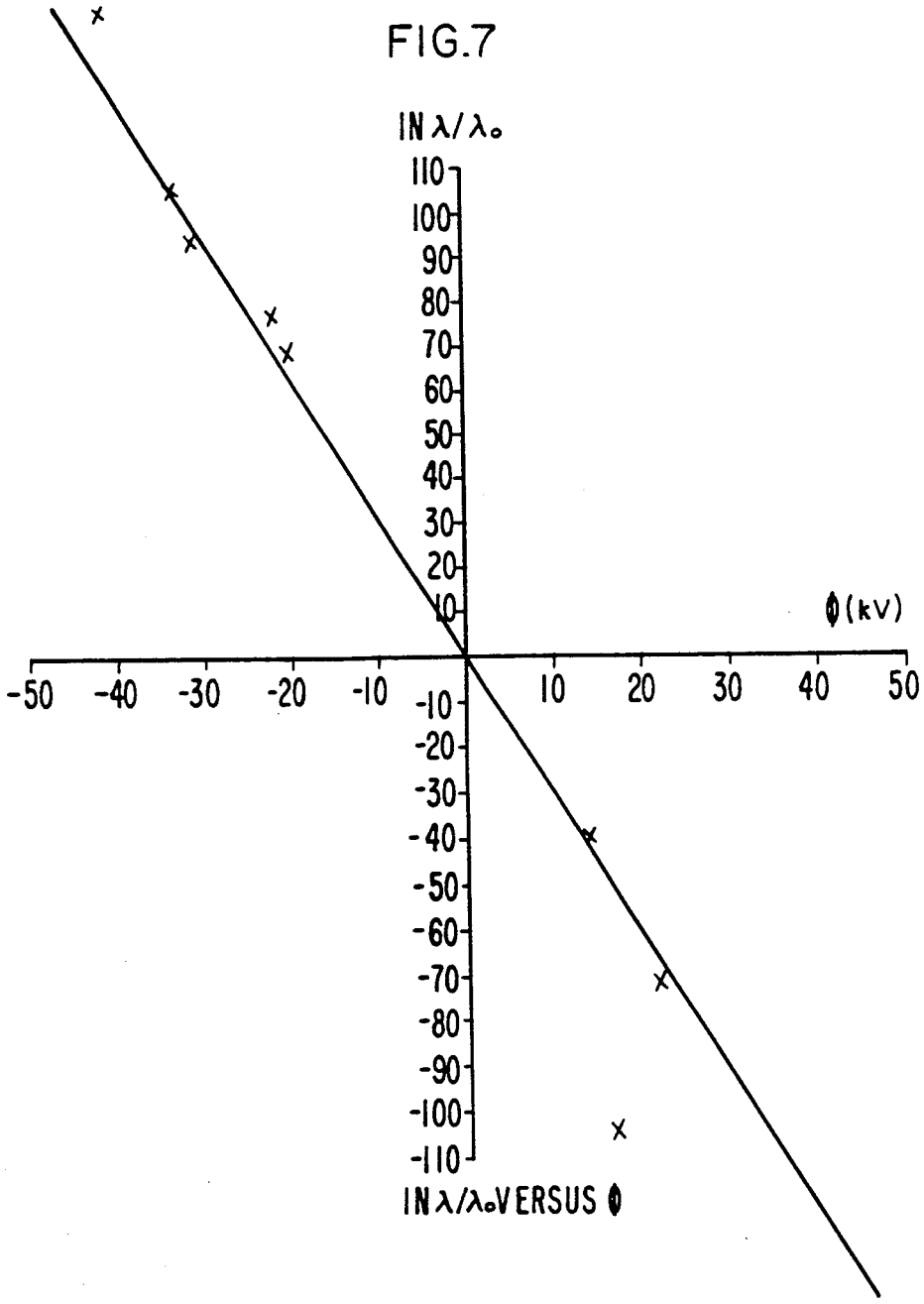
FIG. 7 is a plot of ln $\gamma/\gamma 0$ V. $\phi$.

The first time we assembled the complete system, the experiment on $Th^{230}$ worked. We saw a substantial change in activity when the Van de Graaff voltage was switched from off to on. Since then we have taken over 300 readings which exhibit positive or negative enhancement. Qualitatively the measurements have always agreed with the theory. Quantitatively there is agreement within experimental error for low voltage as can be seen in Table B-1 and FIG. 7. The enhancement values have a standard deviation of about 5%. Each point on the graph is represented by ~20 readings. We estimate the voltage readings to be accurate within ±1.8 kV. Our principal experimental difficulty was in measuring the voltage. About one fourth of our $\ln \lambda/\lambda_0$ values were much too large. We attributed these values, which were not reproducible, to our underestimating the magnitude of $\phi$. One such point is denoted by an asterisk in the Table and on the graph.

TABLE B-1

Theoretical and measured values of $\epsilon$ versus $\phi$ for Thorium 230

| $\phi$ in kV | $\epsilon$th | $\epsilon$m | % Difference |
|---|---|---|---|
| Negative Voltages | | | |
| −3.94 | 0.13 | 0.15 | 13.3 |
| −9.37 | 0.34 | 0.42 | 25.0 |
| −18.8 | 0.80 | 0.91 | 13.8 |
| −21.9 | 0.99 | 1.13 | 14.1 |
| −30.0 | 1.56 | 1.55 | 0.64 |
| −33.0 | 1.81 | 1.80 | 0.52 |
| −42.3 | 2.77 | 3.14 | 13.4 |
| Positive Voltages | | | |
| +13.3 | −0.341 | −0.310 | 9.1 |
| +14.8 | −0.370 | −0.652 | 76.2* |
| +22.6 | −0.508 | −0.494 | 2.76 |

APPENDIX C

Accelerated Alpha Decay by Electrostatic Voltage Excitation

The cavity of the high voltage terminal of a Van de Graaff generator is an equipotential volume. While an electrostatic field exists outside this region, it is zero inside. A charged particle inside the cavity changes its potential energy by $V=q\phi$, where q is the charge and $\phi$ is the voltage difference between the terminal and ground. If $\phi$ is negative, the potential energy of an alpha particle in a radioactive source becomes $2Ze^2/r-2|e\phi|$. This modifies the Coulomb barrier, and by conventional quantum mechanical tunneling theory, leads to an expression for lifetime, which varies substantially with changes in $\phi$. Experiments on $Po^{210}$, two $Th^{230}$ sources, and $Ra^{226}$ confirm this theory.

The electrostatic voltage excitation process has significant applications in the field of nuclear chemistry. This particular type of excitation refers to the change in potential energy experienced by a charged particle when it is placed in a region of homogeneous potential and zero field: $\Delta V=q\phi$, where q is the charge and $\phi$ is the voltage difference between the zero field region and ground. A suitable device which establishes the required electrostatic environment is a Van de Graaff generator. This is best known as an accelerator of positive or negative particles in the MEV energy range. The present application is novel as it does not involve the acceleration of particles. In a Van de Graaff or Pelletron generator, charges are delivered by a belt or insulated links to a conducting surface which encloses a cavity. The focus of our attention is the cavity, which is a region of homogeneous potential and zero field.

In the smaller laboratory demonstration Van de Graaffs, the high voltage terminal is a spherical shell. Consider a negative charge Q on the surface of a sphere of radius "a". It follows from Gauss' theorum that the field in the interior: $\vec{E}=0$, for $r\leqq a$. This is so because no charge is enclosed by a Gaussian surface whose radius is less than "a". Therefore, the interior potential $\phi=$constant, $r\leqq a$, but outside the surface, $\vec{E}=-|Q|/(4\pi\epsilon_0 r^2)\hat{r}$, for $r\geqq a$. The exterior potential is $\phi=-|Q|/(4\pi\epsilon_0 r)$, for $r\geqq a$. The interior potential is continuous at the boundary. Hence $\phi=-|Q|/(4\pi\epsilon_0 a)$, $r\leqq a$. These features are sketched in FIG. 6.

In the interior of the cavity, $0\leqq r\leqq a$, electrostatic voltage excitation takes place. This is an equipotential volume. The potential $\phi=-Q/(4\pi\epsilon_0 a)$ is the voltage difference between this region and the second electrode, which is grounded. Consider the effect of electrostatic voltage excitation on an alpha particle in a radioactive source in the cavity of the high voltage terminal. When a negative $\phi$ is applied, the potential energy of the alpha particle due to this excitation is $$V=-2|e\phi|. \tag{C-1}$$

The basic assumption of this theory is that $\phi$ is homogeneous for all points $0\leqq r\leqq a$. The potential extends inside the radioactive source to each alpha particle trapped in a nuclear well behind its Coulomb barrier. If this were not the case, Gauss' theorum and Coulomb's law would be violated. This mechanism is similar to the potential energy of a nuclear magnetic moment in a magnetic field: $V_{mag}=-\vec{\mu}\cdot\vec{H}$. The homogeneous magnetic field $\vec{H}$ extends to each nuclear magnet inside a paramagnetic sample.

The Schrödinger equation for an alpha particle of mass m is $$\{p^2/2m+2Ze^2/r-2|e\phi|\}\psi=E\psi \tag{C-2}$$

In Eq. (C-2), $2Ze^2/r-2|e\phi|$ is the total potential energy of the alpha particle. The first term represents the Coulomb barrier potential energy, with Z equal to the charge of the daughter nucleus. The second term is present by superposition and represents the effect of electrostatic voltage excitation. Since $\phi$ is negative, the Coulomb barrier is lowered. A positive $\phi$ raises the barrier. The quantity E represents the energy of the alpha particle.

It is well known that even though $E<V_{total}$, alpha decay still takes place by barrier penetration. The transmission coefficient (or Gamow penetrability factor) from quantum mechanics is $$T^*T = e^{-G}, \tag{C-3}$$

$$\text{with } G = 2(2m/h^2)^{\frac{1}{2}}\int_R^b dr(2Ze^2/r - 2|e\phi| - E)^{\frac{1}{2}}. \tag{C-4}$$

In Eq. (C-4), R is the nuclear radius and b is the turning point, namely that value of r for which the integrand vanishes.

$$b=2Ze^2/(E+2|e\phi|). \tag{C-5}$$

A negative $\phi$ lowers the barrier and decreases its thickness. If $b>>R$, the G value becomes $$G = (2\pi Ze^2/h)(2m/(E + 2|e\phi|))^{\frac{1}{2}}. \tag{C-6}$$

Figure 8:
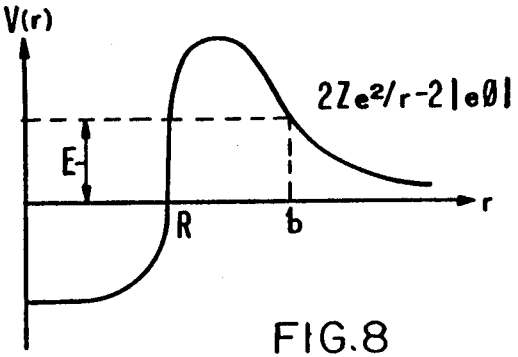
FIG. 8 is a modified potential barrier for an alpha particle.

Clearly a negative potential $\phi$ decreases the transmission coefficient $T^*T$. A sketch of the modified potential energy barrier for alpha decay is given in FIG. 8.

The basic equation which describes radioactive decay is $$dN/dt=-N/\tau, \tag{C-7}$$

where N(t) is the number of radioactive atoms at time t and $\tau$ is the lifetime. The half-life $T_{\frac{1}{2}}=\tau\ln 2$ and the decay rate $\lambda=1/\tau$. The lifetime is $$\tau=\tau_N e^G, \tag{C-8}$$

where $\tau_N$ is the time for an alpha particle to traverse the diameter of the nuclear wall. This is estimated at $\sim 3\times 10^{-21}$ seconds. This value is determined by a fit to the data for natural decay lifetimes, $\tau_0$. Using Eqs. (C-6) and (C-8) and the empirical fit for $\tau_N$, it follows that $$\ln \tau=3.71Z/(E+2|e\phi|)^{\frac{1}{2}}-3.69Z^{\frac{2}{3}}-66.66 \tag{C-9}$$

This is a steady state equation, if $\phi$ is held constant in time. When $\phi=0$, $$\ln \tau_0=3.71Z/E^{\frac{1}{2}}-3.69Z^{\frac{2}{3}}-66.6 \tag{C-10}$$

This is the natural decay lifetime equation. It is well known and agrees very well with experimental values for natural lifetime. It is convenient to combine Eqs. (C-9) and (C-10).

$$\ln \tau/\tau_0 = 3.71Z(1/(E+2|e\phi|)^{\frac{1}{2}} - 1/E^{\frac{1}{2}}) \quad \text{(C-11)}$$

The steady state lifetime is now expressed as a multiple of the natural lifetime.

In the event $|e\phi| << E$, Eq. (C-11) has a useful approximate form:

$$\ln \tau/\tau_0 = 3.71Z|e\phi|/E^{3/2} \quad \text{(C-12)}$$

The central result of the theory of electrostatic excitation, as applied to alpha decay is expressed by Eqs. (C-9), (C-11), and (C-12).

This theory predicts substantial and even dramatic changes in lifetime as the negative voltage is increased in magnitude. These predictions run counter to the traditional view that radioactive lifetimes are immutable. Nevertheless, our experimental data on $Th^{230}$ agree quantitatively with Eq. (C-12) for $0<\phi<50$ kV and qualitatively for $Po^{210}$, $Th^{230}$ and $Ra^{226}$ with Eq. (C-11) for higher voltages. The quantitative experiment on $Th^{230}$ is described in Appendix B. Qualitative confirmation was obtained when electrostatic voltage excitation experiments were carried out on four alpha sources. About six weeks after excitation two of the sources decayed substantially, while the other two are still undergoing accelerated decay.

Polonium 210 and Thorium 230 were excited together in the cavity of the high voltage terminal of a 25 centimeter Van de Graaff generator. The voltage was −400 kV±100 kV. The excitation time period was twelve hours. Both sources were provided by Isotope Products Laboratories. They were open alpha sources with an activity of 0.1 μCi. The polonium identification number is 200-88 (10/1/87). The thorium identification number is SN 172-24-1 (6/1/86). The active deposits were self plating polonium metal on a nickel backing and electrodeposited and diffusion bonded thorium oxide on a platinum backing.

After the high voltage excitation, the activity in both samples was measured several times a day with a Geiger counter. The counting rate was compared to the activity prior to excitation which was 331 cps for $Po^{210}$ and 90.5 cps for $Th^{230}$. Both sources exhibited an oscillatory activity within ±10% of the initial count for a period of about six days. Then there was a marked downward trend in activity. The polonium cps went down by 36.3% and thorium by 65.4%. Oscillations above and below these values continued until activity ceased in a period of about six weeks.

Several months later, Dr. Peter Englert, a radiation chemist at San Jose State University measured these two sources. He used a GM counter shielded in a lead castle. The counting rates for $Po^{210}$ and $Th^{230}$ were 30036 counts/400 minutes and 13601 counts/400 minutes respectively. These correspond to 1.25 cps and 0.566 cps and are to be compared with the pre-excitation values of 331 cps and 90.5 cps respectively. Evidently the alpha activity in both sources has been eliminated as a result of electrostatic voltage excitation.

The lifetimes and alpha energies for $Po^{210}$ and $Th^{230}$ are 199.7 d and $1.088\times10^5$ y and 5.304 MeV and 4.688 MeV respectively. In Table C-1, values for the accelerated lifetimes are given for the two sources at voltages of −300 kV and −500 kV.

TABLE C-1

Accelerated lifetime values for $Po^{210}$ and $Th^{230}$ for two high voltages

| $Po^{210}$: | $\phi$ (kV) | $\tau$ | $Th^{230}$: | $\phi$ (kV) | $\tau$ |
|---|---|---|---|---|---|
| | 0 | 199.7 d | | 0 | $1.088 \times 10^5$ y |
| | −300 | 4.87 h | | −300 | 15.14 y |
| | −500 | 5.16 m | | −500 | 33.32 d |

The observed total alpha decay for $Po^{210}$ and $Th^{230}$ are in qualitative agreement with the theory of electrostatic voltage excitation, as summarized by Eqs. (C-1) to (C-6) inclusive, for a voltage of −500 kV. During the excitation period we measured the voltage by drawing sparks. These ranged up to 16 inches which corresponds to a voltage of −480 kV.

The theory does not predict the behavior of the source after activation. This reaction mode is best described as one of oscillatory decay, with a relaxation time of about six days. During the reaction mode, $Po^{210}$ decayed to $Pb^{206}$ which is a stable isotope, in a single alpha decay. At the same time $Th^{230}$ decayed to the same stable isotope via six alpha and four beta decays. The reaction mode is not clearly understood. However, a study of the details of accelerated decay in $Ra^{226}$ and a second $Th^{230}$ source provides a description of this process.

These two sources were excited separately at voltages of −250 kV±100 kV for a period of six to ten hours. They are open alpha sources, provided by Isotope Product Laboratories, with an activity of 0.1 μCi. The radium identification number is 210-53-2 (2/1/88). The thorium identification number is 210-530-2 (1/1/88). The active deposits were electrodeposited and diffusion bonded radium oxide and thorium oxide on platinum backings. The $Ra^{226}$ source emits a substantial number of gammas as well as alphas. The total pre-excitation alpha and gamma activity was measured with a Geiger counter at 2533 cps. The alphas were filtered out with a piece of paper to yield an initial gamma activity of 1466 cps. Hence the initial alpha activity was 1067 cps. This and subsequent activity measurements were calibrated against a standard $Th^{230}$ alpha source.

Following the high voltage excitation, the $Ra^{226}$ activity has been measured three or four times a day with a Geiger counter. For two days, oscillations of ±5% above and below the initial count were observed. On the third day the alpha count declined by 27.0%. Subsequent declines of 60.9% and 70.7% were observed on the thirteenth and fifteenth days. Range energy measurements indicate the presence of the daughter alphas; $Rn^{222}$, $Po^{216}$, and $Po^{214}$. This data shows that $Ra^{226}$ is in a state of accelerated decay.

The pre-excitation $Th^{230}$ alpha count was 524.2 cps, obtained by subtracting off about seven gamma cps. After excitation, the alpha activity was measured against a standard $Th^{230}$ source with a Geiger counter. These observations were made three or four times a day for about six weeks. During the first seven days, the oscillations had very small amplitudes of about 4% above and 1% below the initial count. Two additional high voltage excitations were administered and a week later the alpha count began to rise dramatically, oscillating about new highs. This is illustrated in Table C-2.

TABLE C-2

Accelerated alpha decay of Thorium 230

| Day | cps | Percent above initial cps |
|---|---|---|
| 15 | 971.9 | 85.4 |

TABLE C-2-continued

| Accelerated alpha decay of Thorium 230 | | |
|---|---|---|
| Day | cps | Percent above initial cps |
| 20 | 1211.9 | 231.1 |
| 23 | 1721.5 | 328.4 |
| 26 | 1996.2 | 380.8 |
| 34 | 2078.9 | 396.5 |
| 38 | 1295.2 | 274.0 |

This relatively high alpha count, above the natural rate, is evidence that some of the activity is due to daughters in the decay chain of $Th^{230}$. A direct confirmation of this hypothesis can be made by range energy measurements in which a search is made for alpha daughters.

The $Th^{230}$ decay chain involves six alpha and four beta emissions.

$$_{90}Th^{230} \xrightarrow[\alpha]{} {}_{88}Ra^{226} \xrightarrow[\alpha]{} {}_{86}Rn^{222} \xrightarrow[\alpha]{} {}_{84}Po^{218} \xrightarrow[\alpha]{} {}_{82}Pb^{214} \xrightarrow[\beta^-]{} {}_{83}Bi^{224} \xrightarrow[\beta^-]{}$$

$$_{84}Po^{214} \xrightarrow[\alpha]{} {}_{82}Pb^{214} \xrightarrow[\beta^-]{} {}_{83}Bi^{210} \xrightarrow[\beta^-]{} {}_{84}Po^{210} \xrightarrow[\alpha]{} {}_{82}Pb^{206}$$

The range in air can be calculated for each of the alpha emitters from the corresponding energy. The relationship is $$R=(0.005E+0.285)E^{3/2} \quad \text{(C-13)}$$

where R is in cm and E is in MeV. The range energy values for each of the alpha emitters in the Thorium 230 chain are given in Table C-3.

TABLE C-3

| Range energy values for Thorium 230 alpha decay chain | | | |
|---|---|---|---|
| Nuclide | Energy (MeV) | $T_{\frac{1}{2}}$ | Range (cm) |
| $Th^{230}$ | 4.687 | $7.54 \times 10^4$ y | 3.129 |
| $Ra^{226}$ | 4.784 | 1600 y | 3.232 |
| $Rn^{222}$ | 5.489 | 3.82 d | 4.012 |
| $Po^{218}$ | 5.181 | 3.11 m | 3.666 |
| $Po^{214}$ | 7.686 | 163 s | 6.89 |
| $Po^{210}$ | 4.516 | 138.4 d | 2.95 |

A Geiger counter was used to measure the activity, as a function of source to sensor distance, using the excited $Th^{230}$ source, calibrated against a standard unexcited $Th^{230}$ source. The data is given in Table C-4.

TABLE C-4

| Activity distance measurements for two thorium sources | | |
|---|---|---|
| Source to sensor distance (cm) | $Th^{230}$ Counts/30 sec above background (.005 Ci calibration source) | (.1 Ci excited source) |
| 0.2 | 19390 *normalized | 19390 |
| 0.4 | 15887 | 16670 |
| 0.6 | 11603 | 12797 |
| 0.8 | 9695 | 7937 |
| 1.0 | 5671 | 6333 |
| 1.2 | 3278 | 2833 |
| 1.4 | 1422 | 858 |
| 1.6 | 1093 | 519 |
| 1.8 | 508 | 384 |
| 2.0 | 225 | 250 |
| 2.2 | 277 | 175 |
| 2.4 | 87 | 129 |
| 2.6 | 87 | 101 |
| 2.8 | 47 | 68 |
| 3.0 | 35 | 47 |
| 3.2 | 0 | 38 |
| 3.4 | 0 | 11 |
| 3.6 | 0 | 15 |

TABLE C-4-continued

| Activity distance measurements for two thorium sources | | |
|---|---|---|
| Source to sensor distance (cm) | $Th^{230}$ Counts/30 sec above background (.005 Ci calibration source) | (.1 Ci excited source) |
| 3.8 | 0 | 5 |
| 4.0 | 0 | 7 |
| 4.2 | 0 | 12 |
| 6.2 | 0 | 5 |

The range for the $Th^{230}$ alphas is given in Table C-3 as 3.129 cm. The cutoff in activity for the calibration source is shown in Table C-4 to be between 3.0 and 3.2 cm. This shows that the only alpha source in this standard is $Th^{230}$. In column two of Table C-4, there is an alpha count which extends beyond 3.0 cm to 6.2 cm. All six alpha emitters listed in Table C-3 could be present. There is definite evidence that $Ra^{226}$ and $Rn^{222}$ are contributing and there is a strong indication that $Po^{214}$ is present. This data demonstrates that $Th^{230}$ is in a state of accelerated decay.

The lifetime and alpha energies for $Ra^{226}$ and $Th^{230}$ are 2308 y and $1.088 \times 10^5$ y respectively. In Table C-5, values for the accelerated lifetime are given for voltages of −150 kV and −350 kV.

TABLE C-5

| Accelerated lifetime values for $Ra^{226}$ and $Th^{230}$ for two high voltages | | | | |
|---|---|---|---|---|
| $Ra^{226}$ | $\phi$ (kV) | $\tau$ | $Th^{230}$ $\phi$ (kV) | $\tau$ |
| | 0 | 2308y | 0 | $1.088 \times 10^5$y |
| | −150 | 28.16y | −150 | 1051y |
| | −350 | 53.33d | −350 | −4.01y |

The observed accelerated alpha decay for $Ra^{226}$ and $Th^{230}$ are again in qualitative agreement with the theory of electrostatic voltage excitation for a voltage of about −350 kV. Periodic spark length measurements ranged up to twelve inches corresponding to voltages of about −350 kV. Because of a much higher relative humidity, these voltages were considerably lower than those observed for the sources which decayed completely.

The theory of accelerated alpha decay by electrostatic voltage excitation agrees qualitatively with the observations on sources which have experienced high voltage excitation. This is clear that high voltages are essential. Low negative voltages accelerate decay but do not lead quickly to total decay. The 25 cm Van de Graaff generators used as excitation sources are not equipped with accurate voltmeters or voltage regulation controls. The research Pelletron generators do have voltage regulation. The voltage on the Van de Graaff oscillates slowly from a few thousand to a few hundred thousand volts. An excitation exposure time of about twelve hours gives the source an opportunity to be excited at the highest attainable voltages for a fraction of this time.

We are satisfied with the theoretical foundation for the excitation process. However, the post-excitation process is not well understood. Evidence on four sources indicates there is a dramatic decline or rise in activity which takes place six days or so after excitation. There may be transient decay times associated with this process comparable to the transient time one observes when a capacitor discharges.

The voltage excitation may be characterized by $$zX^A+2|e\phi| \rightarrow (ZX^A)^* \rightarrow Z-2X^{A-4}+2He^4+E_\alpha^* \quad \text{(C-14)}$$

where $E^*_\alpha = E_\alpha + 2|e\phi|$.

Prior to excitation, the well known natural decay equation is $$dN^0p/dt = -n^0p/\tau_0 \quad \text{(C-15)}$$

where $N^0p$ is the number of nuclei in the parent source at time t and $\tau_0$ is the natural decay time. After the excitation, the reaction mode decay equation is $$dn/dt = -N_p/\tau_p - N_1/\tau_1 - N_2/\tau_2 -, \quad \text{(C-16)}$$

where $N_p$ is the number of parent nuclei, $N_1$ is the number of first daughter nuclei, etc., and $\tau_p$, $\tau_1 \ldots$, are the corresponding reaction mode lifetimes. These are shorter than the natural lifetimes because of the excitation process. The total number of nuclei $N = N_p + N_1 + N_2 \ldots, = N^0_p$ is a constant of the motion. If the k'th daughter is stable, $\tau_k = \infty$. This means that $dN/dt \rightarrow 0$ as $N_k \rightarrow N^0_p$.

The excitation process, which takes place inside the cavity of the high voltage terminal of a Van de Graaff generator, is not directly monitored by a Geiger counter. Evidently the process enhances the population of the various daughter states whose decay is faster than the natural rate.

APPENDIX D

The Theory of Enhanced Beta Decay by Electrostatic Voltage Excitation

Two beta sources, $Tl^{204}$ and $Pb^{210}$ with natural half-lives of 3.78 y and 22.3 y respectively, were placed in the cavity of the high voltage terminal of an electrostatic generator. The voltage was set at $\sim -350$ to $-400$ kV for twelve hours. Six weeks after the voltage was switched off both of these sources showed no activity. Evidently the decay rate was enhanced by $\sim 65.5$ for $Tl^{204}$ and $\sim 387$ for $Pb^{210}$. Electrostatic voltage excitation increases the potential energy of electrons by $|e\phi|$, affecting both the beta minus and each of the atomic electrons. Calculations show that the increase in energy of the beta minus alone accounts for a rate increase of $\sim 25$ for $Tl^{204}$ and $\sim 2500$ for $Pb^{210}$. This agrees with the observations within an order of magnitude. Qualitatively, we expect an ionized sea of electrons will increase the electron density at the nucleus, enhancing the decay rate. The effect is not well understood and additional well documented experiments are needed. A third beta source, $Sr^{90}$, with a half-life of 29 y was submitted to electrostatic voltage excitation for a period of thirteen hours. Ten weeks later it became virtually free of beta activity.

A uniform field and equipotential surfaces are quite common in physics. A zero field and an equipotential volume are not so common. The cavity of the high voltage terminal of a Van de Graaff generator is a region of zero electrostatic field and homogeneous potential. A charge placed in this environment acquires a potential energy of $\Delta V = q\phi$, where q is the charge and $\phi$ is the voltage difference between the high voltage terminal and ground. We call this process electrostatic voltage excitation.

In Appendix C, we described the effect of electrostatic voltage excitation on the rate of alpha decay. As a second application, consider the effect of this process on the rate of beta decay. As a result of this excitation when $\phi$ is negative, the potential energy of the beta particle and of each of the atomic electrons in the beta emitter is $$V = |e\phi|. \quad \text{(D-1)}$$

The basic assumption of this theory is that $\phi$ is homogeneous for all points inside the charged cavity. The potential extends inside the radioactive source to each nucleus and to each atomic electron.

Consider a nucleus at rest which suddenly explodes into three fragments; the daughter nucleus, a beta particle, and a neutrino. At that instant the beta particle has an energy $$E = W + K + |e\phi| = W_o + |e\phi|, \quad \text{(D-2)}$$

where W and K are the energies of the electron and neutrino, inclusive of rest energies, and $W_o$ is the energy of the beta particle when $K = 0$. Inside the cavity a beta particle is not accelerated. Outside the cavity the beta minus is accelerated, attaining a kinetic energy $W_o + e\phi - mc^2$ when it reaches the grounded terminal.

The rate function $f(Z, W_o)$ is central in the theory of natural beta decay.[D-1]

[D-1] E. J. Konopinski, *The Theory of Beta Radioactivity*, Oxford, 1966, p. 16.

The lifetime $$\tau_o = \ln 2/Cf(Z, W_o), \quad \text{(D-3)}$$

where C is constant. Actually, $f\tau_o$ is not a constant for all cases of beta decay. In any case, $f(Z, W_o)$ is a useful analytical starting point. The expression for the rate function is $$f(Z, W_o) = \frac{dW_{cp} W (W_o - W)^2 f(Z, W)}{(mc^2)^5}, \quad \text{(D-4)}$$

where $f(Z, W)$ is the electron density ratio at the nucleus.

$$f(Z, W) = 2\pi\upsilon/(1 - e^{-2\pi\upsilon}) \quad \text{(D-5)}$$

where $$\upsilon = Ze^2/h^2 v \quad \text{(D-6)}$$

and where v = the velocity of the beta particle.

This function has been numerically integrated[D-2] and a graph of $\log_{10} f$ versus $W_o (m_o c^2)$ is given in Reference D-2.

[D-2] E. Feenberg and G. Trigg, Rev. Mod. Phys. 22, 339 (1950).

Electrostatic voltage excitation makes two contributions to an enhanced beta decay rate. The first is due to the increased energy $E = W_o + |e\phi|$ of the beta particle itself. This is taken into account by replacing $W_o \rightarrow W_o + |e\phi|$ in Eq. (D-4). The second is due to the fact that a number of atomic electrons in the beta emitter are ionized. These form a "sea of free electrons" which remain in the immediate vicinity of the source. There is no electrostatic field which sweeps them away. Like the conduction electrons in a metal, these electrons have a higher charge density at the nucleus than do the bound electrons. The beta decay rate increases as the electron charge density at the nucleus increases.

In Table D-1, we calculate the contribution of an increased beta particle energy to a decreased half-life for five beta emitters. We take $|e\phi| = 1$ MeV. The quantities $x_o$ and $W/mc^2$ and $E/mc^2$ respectively. From the graph in Reference D-2, $\log_{10} f(x_o)$ and $\log_{10} f(x)$ can be determined. The decay rate is increased by $f(x)/f(x_o)$. Then it follows that $T_{\frac{1}{2}}=T^o_{\frac{1}{2}}f(x_o)/f(x)$.

TABLE D-1

The change in beta decay half-lives due to a 1 MeV increase in potential energy of the beta particle

| | $W_o$(MeV) | $x_o$ | $f(x_o)$ | E | x | f(x) | $t_{\frac{1}{2}}$ | $t^o_{\frac{1}{2}}$ |
|---|---|---|---|---|---|---|---|---|
| $_{55}Cs^{137}$ | 1.025 | 2.0059 | 1.49 | 2.025 | 3.962 | 158.5 | 103 d | 30.17 y |
| $_{38}Sr^{90}$ | 2.003 | 3.9197 | 79.43 | 3.003 | 5.876 | 631 | 5.10 y | 39.8 y |
| $_{81}Tl^{204}$ | 1.274 | 2.493 | 39.8 | 2.274 | 4.45 | 1000 | 55 d | 3.78 y |
| $_{82}Pb^{210}$ | 0.528 | 1.033 | $3.98 \times 10^{-2}$ | 1.53 | 2.99 | 100 | 3.24 d | 22.3 y |
| $_{89}Ac^{227}$ | 0.556 | 1.089 | 0.1 | 1.556 | 3.045 | 224 | 3.54 d | 21.77 y |

Table D-1 takes into account only the change in energy of the beta particle as a result of the electrostatic voltage excitation. The effect of the ionized sea of electrons is not considered. Experimental data on $Tl^{204}$ and $Pb^{210}$ indicates that the observed increase in decay rate agrees with the increase calculated in Table D-1 in order of magnitude. Thallium 204 decayed completely to background in six weeks following a twelve hour excitation at $\phi \approx -350$–400 kV. Lead 210 is in the Thorium 230 chain. Thorium 230 and all of its daughters decayed to background six weeks after the same twelve hour excitation experienced by $Tl^{204}$.

Several months after our beta depletion experiment on $Tl^{204}$, the source was checked independently by Dr. Peter Englert, a radiation chemist at San Jose State University. Our initial count rate with a GM counter was 674 cps, a value which went to background about six weeks after excitation, as stated above. Dr. Englert observed a count of 4.93 cps using a $Tl^{204}$ calibration source with a GM counter, shielded in a lead castle. He observed a count of 21.1 cps using a $Tc^{99}$ calibration source with a PCS proportional counter. Both of these values have a 10% uncertainty. Within the limits of experimental accuracy, Dr. Englert's observations confirm ours. At least 97% of the beta activity was removed by electrostatic voltage excitation.

$Sr^{90}$ decays by beta emission to $Y^{90}$ which decays by beta emission to $Zr^{90}$. The natural half-lives for these decays are 29y and 2.66d respectively. Prior to excitation, the source activity was measured at 634 cps, of which 498 cps were gammas and 136 cps were betas. In three weeks, the total count rose to 1878 cps and remained at about this level for ten weeks. The beta count underwent oscillatory decay leading to a value of 2.72 cps ten weeks after excitation. FIG. 9 is a plot of the post-excitation decay of $Sr^{90}$.

APPENDIX E

The Fusion of Deuterons in Water by Electrostatic Voltage Excitation

Deuterons in water may be induced to fuse by electrostatic voltage excitation. In this process, a few drops of water are placed in a field free equipotential region which is provided by the cavity of the high voltage terminal of an electrostatic generator. When the cavity surface is negatively charged, the potential energy of a deuteron in water is $e^2/r-|e\phi|$, where $\phi$ is a negative voltage with respect to ground. By conventional quantum mechanics, this decrease in the Coulomb barrier leads to an expression for the lifetime, which is very sensitive to $\phi$. This theory predicts that negative voltages $\sim 10^2$–$10^3$ volts suffice to initiate fusion, which is readily observable. These excitation voltages correspond to temperatures $\sim 1.16\times 10^6$–$1.16\times 10^7$°K., which are in the temperature range for thermonuclear fusion. The mechanism for induced fusion and for enhanced alpha decay are quite similar.

The electrostatic voltage excitation process changes the potential energy of the deuteron in a water sample placed inside the cavity of the high voltage terminal of an electrostatic generator. Take the surface potential $\phi$ of the cavity to be negative. The potential energy of a deuteron due to this excitation is $$V=-|e\phi|. \quad \text{(E-1)}$$

The basic assumption of this theory is that $\phi$ is homogeneous for all points in the interior of the cavity and that the corresponding field is zero. In particular, the potential is constant inside a water drop, where it modifies the Coulomb barrier potential energy of each deuteron so that $$V=e^2/r-|e\phi|, \quad \text{(E-2)}$$

where r is the center to center distance between adjacent deuterons. The quantity $e\phi$, expressed in KeV, is equal to the kinetic temperature, as defined in the standard literature on controlled thermonuclear reactions. The Schrodinger equation is $$(p^2/2\mu+e^2/r-|e\phi|)\psi=E\psi, \quad \text{(E-3)}$$

where $\mu$ is the reduced mass of the fusing particles. Even though $E<V$, fusion may be induced by barrier penetration. The Gamow penetrability factor may be derived using standard quantum mechanics $$T^*T = e^{-G} \quad \text{(E-4)}$$

$$\text{where } G = 2(2\mu/h^2)^{\frac{1}{2}} \int_{2R}^{b} dr(e^2/r - |e\phi|)^{\frac{1}{2}} \quad \text{(E-5)}$$

In Eq. (E-5), R is the radius of a deuteron, b is the turning point, which is the value of r for which the integrand vanishes. Here we take $|e\phi| >> kT$ where T is the ambient temperature. *Controlled Thermonuclear Reactions*, Samuel Glasstone and Ralph Lovberg, Robert Krieger Publishing Co., Molebar, Fla. 1975, p. 28.

$$b=e^2/|e\phi| \quad \text{(E-6)}$$

and $$G=\pi\alpha(2\mu c^2/e\phi)^{\frac{1}{2}} \quad \text{(E-7)}$$

where $\alpha$ is the fine structure constant. The nuclear well transit time $$\tau_o=2R/v. \quad \text{(E-8)}$$

Here $R=1.5\times 10^{-13}$ cm and we estimate v inside the nuclear well from $$E=\mu v^2/2=3kT/2 \quad \text{(E-9)}$$

with T=300° K. Thus the lifetime $$\tau=\tau_o e^G. \quad \text{(E-10)}$$

The essential results of the theory are given by Eqs. (E-7), (E-8) and (E-10).

They apply to the well-known D-D, D-He$^3$ and D-T reactions:

$$1^{D2}+1^{D2}\rightarrow 2He^3+{}_0n^1 \quad \text{(E-11)}$$

$$1^{D2}+1^{D2}\rightarrow 1^{T3}+1^{H1} \quad \text{(E-12)}$$

$$1^{D2}+2He^3\rightarrow 2He^4+1^{H1} \quad \text{(E-13)}$$

$$1^{D2}+1^{T3}\rightarrow 2He^4+{}_0n^1 \quad \text{(E-14)}$$

Both $\tau_o$ and G depend on the reduced mass of the fusing particles. In Table E-1, the values of $\mu$, $\tau_o$, G and $\tau$ are given for the foregoing reactions with $\phi$ taken as $-1000$ volts. This excitation potential corresponds to a thermonuclear temperature of $1.16\times 10^7$°K.

TABLE E-1

Lifetime values for the D-D, D-H$^3$, and D-He$^3$ reactions when the excitation potential is $-1000$ volts.

| Reaction | $\mu$(MeV) | $\tau_o$(sec) | G | $\tau$(sec) |
|---|---|---|---|---|
| D-D | 937.81 | $1.10\times 10^{-18}$ | 31.40 | $4.79\times 10^{-5}$ |
| D-H$^3$ and D-He$^3$ | 1132.4 | $2.09\times 10^{-18}$ | 34.51 | $2.03\times 10^{-3}$ |

It is instructive to use the theory for some representative lifetime-excitation potential calculations. Here we use $$|e\phi|=2\tau^2\alpha^2\mu c^2/(\ln\tau/\tau_o)^2 \quad \text{(E-15)}$$

which follows from Eqs. (E-7), (E-8) and (E-10). In Table E-2, we list the values of $\phi$ required for various lifetimes for the D-D reactions and for the D-He$^3$ and D-T reactions.

TABLE E-2

Excitation potentials required for several fusion lifetimes

| Lifetime | $\phi$ (volts) for D-D reactions | $\phi$ (volts) for D-He$^3$ and D-T reactions |
|---|---|---|
| 1 μs | −1301 | −1650 |
| 1 ms | −831 | −1042 |
| 1 s | −577 | −719 |
| 1 h | −402 | −498 |
| 1 d | −355 | −439 |
| 1 m | −313 | −387 |
| 1 y | −295 | −354 |
| 25 y | −257 | −318 |

About ten experiments were carried out which qualitatively confirm this theory. A few typical experiments follow.

1. Two separate drops of salt water were placed inside a Van de Graaff generator with each drop containing about $10^{15}$ deuterons. The voltage was turned up to about −350 kV and a Geiger counter held near an opening in the upper hemisphere registered off scale. This could have been due to an electron discharge from the generator's surface. The Van de Graaff was opened and the drops were examined. One drop appeared to be intact, and *the other had vanished without a trace.* This is the significant observation, considering that Van de Graaff cavities do not heat up.

2. A single drop of water was placed inside the Van de Graaff. Before excitation the background count was 0.30 cps. Then the Van de Graaff was turned on at the lowest possible belt speed, corresponding to a voltage of about −950 volts. A GM tube was place five feet from the generator and ten, two minute runs were taken. The successive counts were consistenly above background. These were; 0.592, 0.50, 1.46, 0.542, 0.442, 0.425, 0.525, 0.367, 0.60, and 0.533 cps. Near the open port on the upper hemisphere, the count was 8.8 cps for a thirty second run which fell quickly to 0.508 and 0.592 cps. The generator was turned off after fifty minutes of excitation. *Visual inspection inside the cavity showed no trace of the water drop.* Fifteen minutes later the counting rate six feet from the generator was 3.66 cps which was 7.33 times background. Three hours after excitation the count was still 22% above background. These detailed observations suggest that deuteron fusion was initiated at about −950 volts and that a sustained reaction was achieved.

The GM sensor was covered with a thin foil of silver which inhibits electrons from being detected. More importantly, the silver serves as a neutron detector. Neutrons are produced in the fusion reactions described by Eqs. (E-11) and (E-14).

Neutron detection takes place as follows:

$${}_0n^1+{}_{47}Ag^{107}\rightarrow {}_{47}Ag^{108}+\gamma$$

$${}_{47}Ag^{108}\rightarrow {}_{48}Cd^{108}+\beta^-+\eta$$

This detection system was used to observe water energized by electrostatic voltage excitation at low voltages. Copious counts per second were observed.

I claim:

1. A method of energy conversion comprising:
placing a mass of radioactive material in a region;
applying a potential in the range of −50 kV to −5,000 kV to said region so that said region is an equipotential region wherein the radioactive decay of said mass increases upon application of said potential;
capturing the radioactive decay particles in the region whereby the energy of said radioactive particles is transformed to heat energy in the region; and
transferring the heat energy in the region to a coolant.

2. A method of energy conversion comprising:
placing a mass of radioactive material in a region;
applying a selected potential in the range of −50 kV to −5,000 kV to said region thereby increasing the radioactive decay of said mass;
capturing the radioactive decay particles in the region whereby the energy of said radioactive particles is transformed to heat energy in the region; and
transferring the heat energy in the region to a coolant.

3. A method of energy conversion comprising:
placing a mass of material having naturally occurring radioactive alpha decay in a region;
applying a potential in the range of −50 kV to −5,000 kV to said region thereby increasing the alpha decay of said mass;
capturing the alpha particles in the region whereby the energy of said alpha particles is transformed to heat energy in the region; and
transferring the heat energy in the region to a coolant.

4. A method as set forth in any one of claims 1, 2, or 3 wherein said radioactive material includes at least one material in the thorium 323 decay chain.

5. A method as set forth in any one of claims 1, 2, or 3 wherein said radioactive material includes at least one material in the uranium 238 decay chain.

6. A method as set forth in any one of claims 1, 2, or 3 wherein said coolant is fresh water.

7. A method as set forth in any one of claims 1, 2, or 3 wherein said coolant is salt water.

8. A method as set forth in any one of claims 1, 2, or 3 including the step of controlling the radioactive decay of the material thereby controlling the heat energy deposited by the radioactive decay particles in the region.

9. A method as set forth in claim 8 wherein said radioactive decay is controlled by varying the level of said potential in the region.

10. A method as set forth in any one of claims 1, 2, or 3 further comprising the step of moving the coolant in a heat exchange relationship to a fluid so that heat energy in said coolant is transferred to said fluid.

* * * * *